US012796808B1

(12) United States Patent
Poniatowski

(10) Patent No.: US 12,796,808 B1
(45) **Date of Patent: *Nov. 17, 2026**

(54) DESKTOP WORKSPACE THAT ADJUSTS VERTICALLY

(71) Applicant: Office Kick, Inc., Boulder, CO (US)

(72) Inventor: Nathan Mark Poniatowski, St. Petersburg, FL (US)

(73) Assignee: Office Kick, Inc., Boulder, CO (US)

( * ) Notice: Subject to any disclaimer, the term of this patent is extended or adjusted under 35 U.S.C. 154(b) by 32 days.

This patent is subject to a terminal disclaimer.

(21) Appl. No.: 19/193,248

(22) Filed: Apr. 29, 2025

Related U.S. Application Data

(60) Continuation of application No. 18/481,070, filed on Oct. 4, 2023, now Pat. No. 12,318,002, which is a (Continued)

(51) Int. Cl.
*A47B 9/16* (2006.01)
*A47B 21/02* (2006.01)
(Continued)

(52) U.S. Cl.
CPC ..... *A47B 9/16* (2013.01); *A47B 21/02* (2013.01); *A47B 21/0314* (2013.01); *A47B 21/04* (2013.01); *A47B 2021/0335* (2013.01)

(58) Field of Classification Search
CPC ..... A47B 1/03; A47B 21/0314; A47B 21/00; A47B 21/02; A47B 21/03; A47B 21/04; A47B 9/16; A47B 2021/0321; A47B 2021/0364; A47B 2021/0335; A47B 3/00; A47B 61/00; A47B 3/02; A47B 3/0809; A47B 3/0815; A47B 2003/025
(Continued)

(56) References Cited

U.S. PATENT DOCUMENTS 200,057 A 2/1878 Hart
317,468 A 5/1885 Morstatt
(Continued)

FOREIGN PATENT DOCUMENTS

AU 5691386 A 11/1986
AU 580874 B2 2/1989
(Continued)

OTHER PUBLICATIONS

English translation CN203333240 (Year: 2013).*
(Continued)

*Primary Examiner* — Janet M Wilkens
(74) *Attorney, Agent, or Firm* — Lund IP, PLLC

(57) ABSTRACT

A desktop workspace that adjusts vertically includes a work surface platform, a base configured to sit on an existing platform, such as a desk, a height adjustable mechanism including at least one set of arms that connect at a pivot point(s) creating a scissoring motion to raise and lower the said work surface platform to various heights. A locking and unlocking mechanism may connect to the height adjustable mechanism. In some cases, the apparatus includes an adjustable mechanism to support items such as a keyboard. In some cases, the apparatus includes elements to raise items such as a monitor to an additional height.

25 Claims, 29 Drawing Sheets

Related U.S. Application Data continuation of application No. 17/985,137, filed on Nov. 10, 2022, now Pat. No. 11,910,926, which is a continuation of application No. 17/493,812, filed on Oct. 4, 2021, now Pat. No. 11,944,196, which is a continuation of application No. 16/785,647, filed on Feb. 9, 2020, now Pat. No. 11,134,773, which is a continuation of application No. 16/372,334, filed on Apr. 1, 2019, now Pat. No. 10,575,630, which is a division of application No. 15/628,558, filed on Jun. 20, 2017, now Pat. No. 10,244,861, which is a division of application No. 15/004,926, filed on Jan. 23, 2016, now abandoned.

(60) Provisional application No. 62/107,380, filed on Jan. 24, 2015.

(51) Int. Cl.
*A47B 21/03* (2006.01)
*A47B 21/04* (2006.01)

(58) Field of Classification Search
USPC ..... 312/208.1, 223.3; 248/421, 562, 588, 248/585, 431, 432, 439; 108/47, 144.11, 108/145, 93, 96, 28
See application file for complete search history.

(56) References Cited

U.S. PATENT DOCUMENTS 606,845 A 7/1898 Simmons
835,247 A 11/1906 Morgan
1,217,772 A 2/1917 Kade
1,318,564 A 10/1919 Jenkins
2,225,243 A 12/1940 Zottel
2,260,695 A 10/1941 Self
2,692,807 A 10/1954 Fred
2,843,418 A 7/1958 Gray
2,916,340 A 12/1959 Jackson
2,937,003 A 5/1960 Croll
3,092,918 A 6/1963 Haeussermann et al.
3,110,476 A 11/1963 Farris
3,152,833 A 10/1964 Creveling et al.
3,282,566 A 11/1966 Clarke
3,295,800 A 1/1967 Karl-Erik et al.
3,404,791 A 10/1968 Roy
3,444,830 A 5/1969 Doetsch
3,727,245 A 4/1973 Gerth
3,823,915 A 7/1974 Koehler
3,826,457 A 7/1974 De
4,072,288 A 2/1978 Wirges et al.
4,097,941 A 7/1978 Merkel
4,221,280 A 9/1980 Richards
4,249,749 A 2/1981 Collier
4,382,573 A 5/1983 Aondetto
4,403,680 A 9/1983 Hillesheimer
4,433,759 A 2/1984 Ichinose
4,448,386 A 5/1984 Moorhouse et al.
4,449,262 A 5/1984 Jahsman et al.
4,534,544 A 8/1985 Heide
4,549,720 A 10/1985 Bergenwall
4,558,648 A 12/1985 Franklin et al.
4,558,847 A 12/1985 Coates
4,574,785 A 3/1986 Yamamoto
4,577,821 A 3/1986 Edmo et al.
4,611,823 A 9/1986 Haas
4,625,657 A 12/1986 Little et al.
4,640,488 A 2/1987 Sakamoto
4,659,052 A 4/1987 Nagata
4,702,454 A 10/1987 Izumida
4,709,972 A 12/1987 LaBudde et al.
4,717,112 A 1/1988 Pirkle
4,741,512 A 5/1988 Elkuch et al.
4,753,419 A 6/1988 Johansson
4,826,123 A 5/1989 Hannah et al.
4,843,978 A 7/1989 Schmidt et al.
D302,893 S 8/1989 Wakefield
4,899,987 A 2/1990 Craig
4,909,159 A 3/1990 Gonsoulin
D308,537 S 6/1990 Clark
4,941,641 A 7/1990 Granzow et al.
4,967,672 A 11/1990 Leather
4,995,130 A 2/1991 Hahn et al.
5,037,163 A 8/1991 Hatcher
5,048,784 A 9/1991 Schwartz et al.
5,074,000 A 12/1991 Soltani et al.
5,211,367 A 5/1993 Musculus
5,251,864 A 10/1993 Itou
5,257,767 A 11/1993 McConnell
5,294,087 A 3/1994 Drabczyk et al.
5,400,720 A 3/1995 Stevens
5,460,460 A 10/1995 Alexander
5,580,027 A 12/1996 Brodersen
5,588,377 A 12/1996 Fahmian
5,588,727 A 12/1996 D'Agaro et al.
5,626,323 A 5/1997 Lechman et al.
5,632,209 A 5/1997 Sakakibara
5,694,864 A 12/1997 Langewellpott
5,695,173 A 12/1997 Ochoa et al.
5,722,513 A 3/1998 Rowan et al.
5,729,430 A 3/1998 Johnson
5,765,797 A 6/1998 Greene et al.
5,823,487 A 10/1998 Kirchhoff et al.
5,829,948 A 11/1998 Becklund
5,836,562 A 11/1998 Danzyger et al.
5,895,020 A 4/1999 Danzyger et al.
5,926,876 A 7/1999 Haigh et al.
5,957,426 A 9/1999 Brodersen
6,076,785 A 6/2000 Oddsen, Jr.
6,098,961 A 8/2000 Gionet
6,135,546 A 10/2000 Demtchouk
6,148,739 A 11/2000 Martin
6,176,456 B1 1/2001 Wisniewski
6,179,261 B1 1/2001 Lin
6,220,558 B1 4/2001 Broder et al.
6,269,753 B1 8/2001 Roddan
6,273,382 B1 8/2001 Pemberton
6,381,335 B2 4/2002 Juszkiewicz et al.
6,488,248 B1 12/2002 Watt et al.
6,516,478 B2 2/2003 Cook et al.
6,533,229 B1 3/2003 Hung
6,533,479 B2 3/2003 Kochanski
6,550,740 B1 4/2003 Burer
6,672,430 B2 1/2004 Boucher et al.
6,701,853 B1 3/2004 Hwang
6,702,372 B2 3/2004 Tholkes et al.
6,722,618 B1 4/2004 Wu
6,742,768 B2 6/2004 Alba
6,792,876 B2 9/2004 Lin
6,857,493 B2 2/2005 Shupp et al.
6,938,866 B2 9/2005 Kirchhoff
7,048,236 B2 5/2006 Benden et al.
7,188,813 B2 3/2007 Kollar
7,204,193 B2 4/2007 Scherrer et al.
7,207,629 B2 4/2007 Goetz et al.
7,246,784 B1 7/2007 Lopez
7,568,675 B2 8/2009 Catton
7,575,205 B2 8/2009 Kirchhoff
7,677,518 B2 3/2010 Chouinard et al.
D622,350 S 8/2010 Gramegna et al.
7,793,597 B2 9/2010 Bart et al.
7,841,570 B2 11/2010 Mileos et al.
7,845,665 B2 12/2010 Borisoff
7,946,551 B1 5/2011 Cvek
7,950,338 B2 5/2011 Smed
7,988,232 B2 8/2011 Weber et al.
8,015,638 B2 9/2011 Shimada et al.
8,132,518 B2 3/2012 Kim et al.
8,303,062 B2 11/2012 Zanelli
8,469,152 B2 6/2013 Olsen et al.
8,490,933 B2 7/2013 Papic et al.
8,544,391 B2 10/2013 Knox et al.

(56) References Cited

U.S. PATENT DOCUMENTS 8,671,853 B2 3/2014 Flaherty
8,684,339 B2 4/2014 Deml et al.
8,800,976 B2 8/2014 Bethina et al.
8,931,750 B2 1/2015 Kohl et al.
8,950,343 B2 2/2015 Huang
9,049,923 B1 6/2015 Delagey et al.
9,055,810 B2 6/2015 Flaherty
9,113,703 B2 8/2015 Flaherty
9,133,974 B2 9/2015 Tholkes et al.
9,133,976 B2 9/2015 Lin et al.
9,232,855 B2 1/2016 Ergun et al.
9,326,598 B1 5/2016 West et al.
9,440,559 B2 9/2016 Gundall et al.
9,480,332 B2 11/2016 Han
9,504,316 B1 11/2016 Streicher et al.
9,554,644 B2 1/2017 Flaherty et al.
9,630,819 B2 4/2017 Ong
9,668,572 B2 6/2017 Ergun et al.
9,681,746 B1 6/2017 Chen
9,809,136 B2 11/2017 Haller et al.
9,815,672 B2 11/2017 Baudermann
9,854,904 B2 1/2018 Getz
9,955,780 B2 5/2018 Koch
9,961,991 B1 5/2018 Chen
9,981,571 B2 5/2018 Garing
9,993,068 B2 6/2018 Lin et al.
10,018,298 B2 7/2018 Goldish et al.
10,023,355 B2 7/2018 Taylor et al.
D830,739 S 10/2018 Min
10,114,352 B2 10/2018 Matlin
D832,623 S 11/2018 Flaherty et al.
10,123,613 B2 11/2018 Hall et al.
10,159,336 B2 12/2018 Liao et al.
D841,014 S 2/2019 Laudadio et al.
D845,037 S 4/2019 Min
D845,678 S 4/2019 Laudadio et al.
10,244,861 B1 4/2019 Poniatowski
10,258,148 B1 4/2019 Donner et al.
10,258,149 B2 4/2019 Zhong
10,264,877 B2 4/2019 Hu et al.
10,306,977 B2 6/2019 Wong
D854,775 S 7/2019 Chang et al.
10,405,647 B2 9/2019 Laudadio et al.
10,413,055 B2 9/2019 Laudadio et al.
D862,936 S 10/2019 Laudadio et al.
10,485,336 B1 11/2019 Laudadio et al.
D870,490 S 12/2019 Hu
10,499,730 B2 12/2019 Kim et al.
10,517,390 B2 12/2019 Xiang et al.
10,524,565 B2 1/2020 Ergun et al.
10,542,817 B2 1/2020 Swartz et al.
10,544,019 B2 1/2020 Kochie et al.
10,568,416 B1 2/2020 Poniatowski
10,575,630 B1 3/2020 Poniatowski
D901,959 S 11/2020 Chang
10,849,424 B2 12/2020 Laudadio et al.
10,869,549 B2 12/2020 Xiang et al.
10,893,748 B1 1/2021 Poniatowski
11,058,217 B2 7/2021 Laudadio et al.
11,083,282 B1 8/2021 Liu
11,134,773 B1 10/2021 Poniatowski
11,134,774 B1 10/2021 Poniatowski
11,140,977 B1 10/2021 Poniatowski
11,147,366 B1 10/2021 Poniatowski
11,160,367 B1 11/2021 Poniatowski
11,219,307 B2 1/2022 Laudadio et al.
11,388,989 B1 7/2022 Poniatowski
11,388,991 B1 7/2022 Poniatowski
11,395,544 B1 7/2022 Poniatowski
11,464,325 B1 10/2022 Poniatowski
11,470,959 B1 10/2022 Poniatowski
11,717,080 B2 8/2023 Laudadio et al.
11,771,218 B2 10/2023 Laudadio et al.
11,800,927 B1 10/2023 Poniatowski
11,849,843 B1 12/2023 Poniatowski
11,857,073 B1 1/2024 Poniatowski
11,864,654 B1 1/2024 Poniatowski
11,910,926 B1 2/2024 Poniatowski
11,925,264 B1 3/2024 Poniatowski
11,944,196 B1 4/2024 Poniatowski
11,950,699 B1 4/2024 Poniatowski
11,980,289 B1 5/2024 Poniatowski
12,082,695 B1 9/2024 Poniatowski
12,082,696 B1 9/2024 Poniatowski
12,102,229 B1 10/2024 Poniatowski
12,121,149 B1 10/2024 Poniatowski
12,193,569 B1 1/2025 Poniatowski
12,226,015 B1 2/2025 Poniatowski
12,256,842 B1 3/2025 Poniatowski
12,318,002 B1 6/2025 Poniatowski
12,318,003 B1 6/2025 Poniatowski
12,342,937 B1 7/2025 Poniatowski
12,593,912 B1 4/2026 Poniatowski
2003/0042380 A1 3/2003 Hagglund et al.
2003/0213415 A1 11/2003 Ross et al.
2004/0035332 A1 2/2004 Lin
2004/0040480 A1 3/2004 Hwang
2005/0029849 A1 2/2005 Goetz et al.
2005/0120922 A1 6/2005 Brooks
2007/0001077 A1 1/2007 Kirchhoff
2007/0080564 A1 4/2007 Chen
2007/0266912 A1 11/2007 Swain
2007/0295882 A1 12/2007 Catton
2008/0000393 A1 1/2008 Wilson et al.
2009/0090832 A1 4/2009 Mileos et al.
2009/0145336 A1 6/2009 Kenny
2009/0146389 A1 6/2009 Borisoff
2009/0200437 A1 8/2009 Smed
2010/0242174 A1 9/2010 Morrison et al.
2010/0257671 A1 10/2010 Shimada et al.
2011/0001033 A1 1/2011 Kohl et al.
2011/0024958 A1 2/2011 Deml et al.
2012/0060291 A1 3/2012 Gamman et al.
2012/0097822 A1 4/2012 Hammarskiöld
2012/0188302 A1 7/2012 Zanelli
2013/0145972 A1 6/2013 Knox et al.
2013/0193392 A1 8/2013 McGinn
2013/0199420 A1 8/2013 Hjelm
2013/0340655 A1 12/2013 Flaherty
2014/0041554 A1 2/2014 Huang
2014/0144352 A1 5/2014 Roberts
2014/0158026 A1 6/2014 Flaherty
2014/0248114 A1 9/2014 Sawyer
2014/0339747 A1 11/2014 Bethina et al.
2014/0360411 A1 12/2014 Hatter
2015/0028787 A1 1/2015 Sekine et al.
2015/0216296 A1* 8/2015 Mitchell ..... B62B 3/02
280/638
2015/0231992 A1 8/2015 Gundall et al.
2015/0232005 A1 8/2015 Haller et al.
2015/0274038 A1 10/2015 Garing
2015/0289641 A1 10/2015 Ergun et al.
2015/0368082 A1 12/2015 Davis et al.
2015/0375896 A1 12/2015 Taylor et al.
2016/0051042 A1 2/2016 Koch
2016/0060084 A1 3/2016 Baudermann
2016/0106205 A1 4/2016 Hall et al.
2016/0170402 A1 6/2016 Lindström
2016/0249737 A1 9/2016 Han
2016/0258573 A1 9/2016 Goldish et al.
2016/0260019 A1 9/2016 Ruiz et al.
2016/0309889 A1 10/2016 Lin et al.
2016/0338486 A1 11/2016 Martin
2016/0353880 A1 12/2016 Sigal et al.
2017/0071332 A1 3/2017 Herring et al.
2017/0174486 A1 6/2017 Kochie et al.
2017/0196351 A1 7/2017 Failing
2017/0354245 A1 12/2017 Martin et al.
2017/0360192 A1 12/2017 Hu
2018/0008037 A1 1/2018 Laudadio
2018/0055214 A1 3/2018 Kim et al.
2018/0103752 A1 4/2018 Zhong
2018/0125227 A1 5/2018 Xiang et al.
2018/0160799 A1 6/2018 Westergård et al.

(56) References Cited

U.S. PATENT DOCUMENTS

| | | | |
|---|---|---|---|
| 2018/0177289 | A1 | 6/2018 | Chen |
| 2018/0213929 | A1 | 8/2018 | Ergun et al. |
| 2018/0255919 | A1 | 9/2018 | Swartz et al. |
| 2018/0279770 | A1 | 10/2018 | Crowe et al. |
| 2018/0360208 | A1 | 12/2018 | Liao et al. |
| 2019/0110588 | A1 | 4/2019 | Wong |
| 2019/0183239 | A1 | 6/2019 | Semmelrath et al. |
| 2019/0269237 | A1 | 9/2019 | Zhu |
| 2020/0029685 | A1 | 1/2020 | Du et al. |
| 2020/0107633 | A1 | 4/2020 | Kang |
| 2023/0329430 | A1 | 10/2023 | Laudadio et al. |

FOREIGN PATENT DOCUMENTS

| | | | | |
|---|---|---|---|---|
| AU | 2014216002 | A1 | | 3/2015 |
| CA | 2814945 | C | | 4/2019 |
| CN | 1142343 | A | | 2/1997 |
| CN | 2637251 | Y | | 9/2004 |
| CN | 2781893 | Y | | 5/2006 |
| CN | 201657970 | U | | 12/2010 |
| CN | 102599728 | A | | 7/2012 |
| CN | 202681005 | U | | 1/2013 |
| CN | 202681013 | U | | 1/2013 |
| CN | 202874336 | U | | 4/2013 |
| CN | 101711220 | B | | 11/2013 |
| CN | 203333240 | U | * | 12/2013 |
| CN | 103653780 | A | | 3/2014 |
| CN | 203934825 | U | | 11/2014 |
| CN | 204541230 | U | * | 8/2015 |
| CN | 105124920 | A | | 12/2015 |
| CN | 204949970 | U | | 1/2016 |
| CN | 104692286 | B | | 4/2017 |
| CN | 104540707 | B | | 5/2017 |
| CN | 107048694 | A | | 8/2017 |
| CN | 107048695 | A | | 8/2017 |
| CN | 107212587 | A | | 9/2017 |
| CN | 107744256 | A | | 3/2018 |
| CN | 107756350 | A | | 3/2018 |
| CN | 107912868 | A | | 4/2018 |
| CN | 207186305 | U | | 4/2018 |
| CN | 109008216 | A | | 12/2018 |
| CN | 208403596 | U | | 1/2019 |
| CN | 110840072 | A | | 2/2020 |
| CN | 108024625 | B | | 8/2021 |
| DE | 2851555 | A1 | | 6/1980 |
| DE | 3519787 | C2 | | 12/1986 |
| DE | 8606822 | U1 | | 8/1991 |
| DE | 9302967 | U1 | | 4/1993 |
| DE | 4424564 | A1 | | 1/1996 |
| DE | 29515642 | U1 | | 1/1996 |
| DE | 69111809 | T2 | | 4/1996 |
| DE | 19526596 | A1 | | 12/2004 |
| DE | 102013008020 | A1 | | 11/2014 |
| DE | 202016101126 | U1 | | 6/2016 |
| EP | 0342779 | B1 | | 5/1993 |
| EP | 0531385 | B1 | | 8/1995 |
| EP | 0448340 | B1 | | 2/1996 |
| EP | 0613852 | B1 | | 11/1997 |
| EP | 2745733 | A1 | | 6/2014 |
| EP | 3092918 | A1 | | 11/2016 |
| FR | 2252835 | A1 | | 6/1975 |
| FR | 2637165 | A1 | | 4/1990 |
| FR | 2894794 | A1 | | 6/2007 |
| FR | 3028735 | A1 | | 5/2016 |
| JP | S61162495 | | * | 7/1986 |
| JP | 2012030022 | A | | 2/2012 |
| JP | 5861051 | B2 | | 2/2016 |
| JP | 2017045506 | A | | 3/2017 |
| KR | 100802663 | B1 | | 2/2008 |
| KR | 20110006306 | U | | 1/2011 |
| KR | 20140004886 | U | | 9/2014 |
| KR | 101527121 | B1 | | 6/2015 |
| KR | 101551337 | B1 | * | 9/2015 ..... A47B 37/00 |
| KR | 200479292 | Y1 | | 1/2016 |
| KR | 20160074221 | A | | 6/2016 |
| KR | 101635611 | B1 | | 7/2016 |
| KR | 101747132 | B1 | | 6/2017 |
| KR | 101969133 | B1 | | 8/2019 |
| NL | 1011051 | C2 | | 7/2000 |
| NL | 2000346 | C2 | | 5/2008 |
| TW | I531523 | B | | 5/2016 |
| TW | I531523 | B | | 5/2016 |
| WO | 8304168 | A1 | | 12/1983 |
| WO | 8606053 | A1 | | 10/1986 |
| WO | 1986006054 | A1 | | 10/1986 |
| WO | 1988005759 | A1 | | 8/1988 |
| WO | 1991011979 | A1 | | 8/1991 |
| WO | 1991017906 | A1 | | 11/1991 |
| WO | 2006009531 | A2 | | 1/2006 |
| WO | 2008002373 | A2 | | 1/2008 |
| WO | 2012118435 | A1 | | 9/2012 |
| WO | 2014027010 | A1 | | 2/2014 |
| WO | 2014180572 | A1 | | 11/2014 |
| WO | 2015160825 | A2 | | 10/2015 |
| WO | 2016129971 | A1 | | 8/2016 |
| WO | 2016187212 | A1 | | 11/2016 |
| WO | 2016200318 | A1 | | 12/2016 |
| WO | 2017045506 | A1 | | 3/2017 |
| WO | 2017053200 | A1 | | 3/2017 |
| WO | 2018093007 | A1 | | 5/2018 |
| WO | 2019001506 | A1 | | 1/2019 |
| WO | 2019001507 | A1 | | 1/2019 |

OTHER PUBLICATIONS

KR101551337 English translation (Year: 2015).*

"Easylift Gas Springs: Technical Information," Web page, Aug. 24, 2008, retrieved from Internet Archive Wayback Machine on Aug. 29, 2022.

Adjustable Desk: VARIDESK, http://www.varidesk.com, United States of America, Mar. 30, 2013.

Ergotron, http://www.ergotron.com, United States of America, Sep. 29, 2014.

Levine, James A. "Sitting down is Killing you! Heart disease, obesity, depression and crumbling bones—a terrifying new book by a top doctor reveals they are all linked to the hours we spend in chairs" Daily Mail Online, Jul. 26, 2014, 9 pages [online], [retrieved on Jun. 30, 2017]. Retrieved from the Internet at: http://www.dailymail.co.uk/news/article-2706317.

Lohr, Steve, Taking a Stand for Office Ergonomics, Dec. 1, 2012, New York Times, United States, retrieved from http://www.nytimes.com/2012/12/02/business/stand-up-desks-gaining-favor-in-the-workplace.html on Aug. 29, 2022.

* cited by examiner

DESKTOP WORKSPACE THAT ADJUSTS VERTICALLY

CROSS REFERENCE TO RELATED APPLICATIONS

This application is a continuation application of U.S. patent application Ser. No. 18/481,070, titled DESKTOP WORKSPACE THAT ADJUSTS VERTICALLY, filed Oct. 4, 2023, which is a continuation application of U.S. patent application Ser. No. 17/985,137, titled DESKTOP WORKSPACE THAT ADJUSTS VERTICALLY, issued as U.S. Pat. No. 11,910,926 on Feb. 27, 2024, which is a continuation application of U.S. patent application Ser. No. 17/493,812, titled DESKTOP WORKSPACE THAT ADJUSTS VERTICALLY, issued as U.S. Pat. No. 11,944,196 on Apr. 2, 2024, 2024, which is a continuation application of U.S. patent application Ser. No. 16/785,647, titled DESKTOP WORKSPACE THAT ADJUSTS VERTICALLY, issued as U.S. Pat. No. 11,134,773 on Oct. 5, 2021, which is a continuation application of U.S. patent application Ser. No. 16/372,334, titled DESKTOP WORKSPACE THAT ADJUSTS VERTICALLY, issued as U.S. Pat. No. 10,575,630 on Mar. 3, 2020, which is a divisional application of Ser. No. 15/628,558, titled DESKTOP WORKSPACE THAT ADJUSTS VERTICALLY, issued as U.S. Pat. No. 10,244,861 on Apr. 2, 2019, which is a divisional application of U.S. patent application Ser. No. 15/004,926, titled DESKTOP WORKSPACE THAT ADJUSTS VERTICALLY, filed Jan. 23, 2016, which claims the benefit of U.S. Provisional Patent Application No. 62/107,380, titled DESKTOP WORKSPACE THAT ADJUSTS VERTICALLY, filed Jan. 24, 2015. The entire contents of each of these related applications is incorporated by reference herein.

TECHNICAL FIELD

This disclosure relates to a desktop workspace platform that adjusts up and down vertically.

BACKGROUND

In recent years studies have been conducted to show the health benefits of not sitting or standing for prolonged periods of time. It has been shown that sitting for long periods of time, day after day, increases the rate of all-cause mortality. It has even been said that sitting is the new smoking. A healthier work environment could be achieved by standing a portion of your day that you typically spend sitting. A combination of standing and sitting can reduce your risk of obesity, diabetes, cardiovascular disease and cancer.

There are many different types of work surfaces today. Most of these are stationary, in that they do not adjust in height. In recent years, entire desks that adjust in height have become more common. Most people already have a stationary desk, so purchasing an entire new desk may be unreasonable for some.

SUMMARY

There are a few adjustable desk platforms that sit on an existing desk, however, designs of such products have left much room for improvement. Some notable areas for improvement include, but are not limited to; the need for straight vertical motion of the desktop platform where the work surface does not protrude out toward the operator when elevated, a motorized adjustable height mechanism or other motor assisted system, a holding or locking mechanism that does not limit the work surface to only preset heights, a higher maximum adjustable height to satisfy taller users, improved load distribution, improved design, improved appearance, increased load capacity, and a more compact design once in a lowered position.

A desktop workspace that adjusts vertically includes a work surface platform that acts as a work surface platform. A height adjustment mechanism allows the work surface platform to raise and lower to the desired height of the operator. This desktop workspace includes at least one set of arms as part of the height adjustment mechanism that utilizes a scissor motion to move the work surface platform up and down.

In one example, a desktop workspace that adjusts vertically is comprised of a work surface platform; a base configured to sit on an existing platform such as a desk; a height adjustable mechanism including at least one set of arms that connect at a pivot point creating a scissoring motion as part of the method to raise and lower the said work surface platform to various heights.

DETAILED DESCRIPTION

The Desktop Workspace That Adjusts Vertically, also referred to as the "desktop workspace" in this document, includes a device and a method to raise and lower a platform that is part of the device. An exemplary use of the device is a work surface such as a desk, which can be moved to a desired vertical position. For example, the platform could hold objects such as a laptop, monitor, tablet, keyboard, mouse, and other desk items such as a stapler. The Desktop Workspace That Adjusts Vertically may include ancillary devices such as a monitor raiser, an external keyboard holder, mouse holder, cable organizer, or other devices. The platform raises vertically without protruding out along the horizontal plane, keeping the individual using the device from having to step backward to use the work surface platform when it is in a raised position. This configuration allows the operator to utilize the work surface platform at various heights. The examples and description suggest the device is used for supporting typical desktop objects, but the scope of this disclosure is intended to support other objects and to be used in other applications.

The Desktop Workspace That Adjusts Vertically can be placed on an existing surface to provide a variable height working area that is adjusted by the operator. The Desktop Workspace That Adjusts Vertically includes at least one set of two arms that connect along their lengths at a pivot point, allowing a scissoring motion, which is part of the method for raising and lowering the work surface platform. When raised, the work surface platform raises in a substantially straight motion so that it stays in-line with the base. An element or mechanism such as a spring or motor is configured to provide a force to assist in the elevation of the work surface platform. A locking mechanism is configured to secure the work surface platform at a given height.

The Desktop Workspace That Adjusts Vertically includes a height adjustment mechanism configured to assist in raising the work surface platform parallel to the surface it sits on, without moving back and forth or left to right; keeping the individual using the device from having to move backward to use the work surface platform when it is in a raised position. The height adjustment mechanism(s) may include items such as springs, gas springs, shock absorbers, an electric motor(s), or a linear actuator(s).

The Desktop Workspace That Adjusts Vertically is directed to help individuals from sitting or standing for prolonged periods of time while they work. Studies have shown that sitting or standing for long periods of time can be detrimental to one's health.

The Desktop Workspace That Adjusts Vertically is designed to assist individuals to be more alert and productive as they work. Studies show that moving from a sitting to standing position and vice versa help the human body to be more awake and alert.

Figure 1:
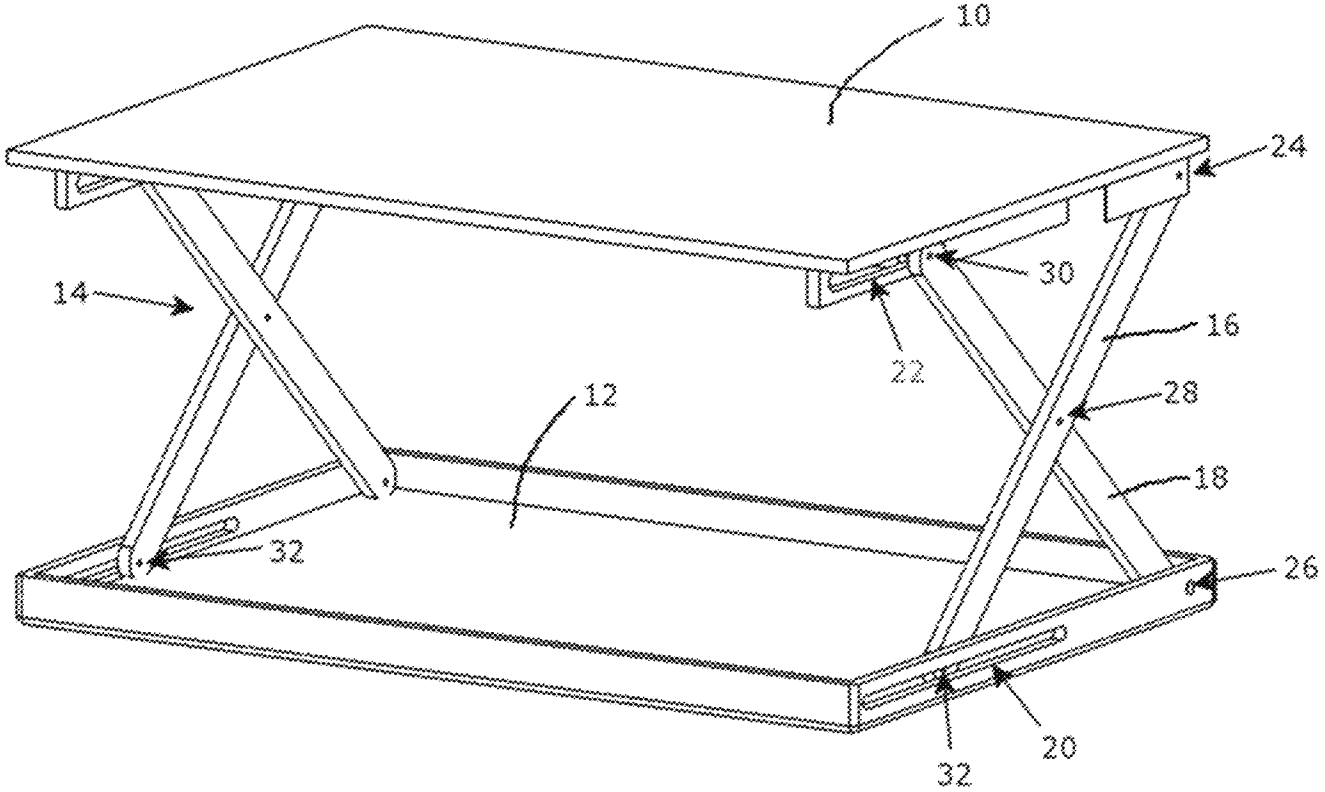
FIG. 1 is a perspective view of an example adjustable desk including a work surface platform, base, and height adjustment mechanism.

FIGS. 1, 1B, 1C, 2, 2B, 2C, 6, 7, 7B, 9, and 10C show examples of The Desktop Workspace That Adjusts Vertically an assembled state. As shown, the desktop workspace includes a work surface platform 10, a base 12, and a height adjustment mechanism 14 residing between the work surface platform 10 and base 12. The examples show that platform 10 is a work surface platform that supports desk items; for example, monitors, tablets, Computers, notebooks, and other objects. The height adjustment example 14 includes at least one set of two arms 16 & 18. Arms 16 & 18 are connected at some point along their shafts at pivot point 28. These pivoting arms connect at pivot points 24 and 26 on one end and slide along a sliding mechanism 20 or 22 at pivot and sliding point 30 or 32. The arms pivot at 28, arm 16 slides along 20 and arm 18 slides along 22, creating a scissor motion to allow the work surface platform 10 to move up and down. This example with the pivoting arms moving in the scissor motion is the basis of the height adjustment mechanism 14. Base 12 is the base that the height adjustment mechanism 14 connects to. Base 12 consists of one piece of material or multiple pieces of material. FIG. 1 portrays base 12 as one piece, while FIG. 1B portrays base 12 as two pieces, and FIG. 1C portrays base 12 as one piece with portions removed.

Figure 1B:
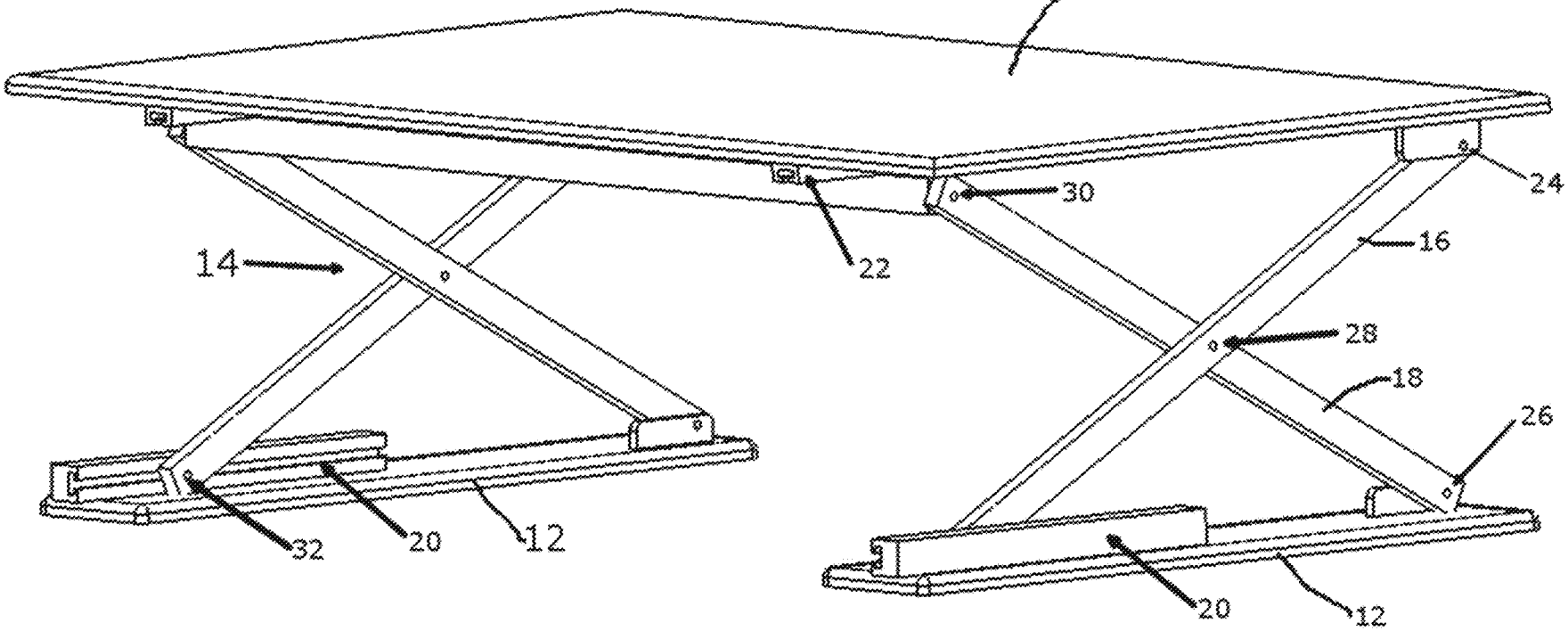
FIG. 1B is a perspective view of an example adjustable desk including a work surface platform, base, and height adjustment mechanism, with alternative sliding mechanisms.
Figure 1C:
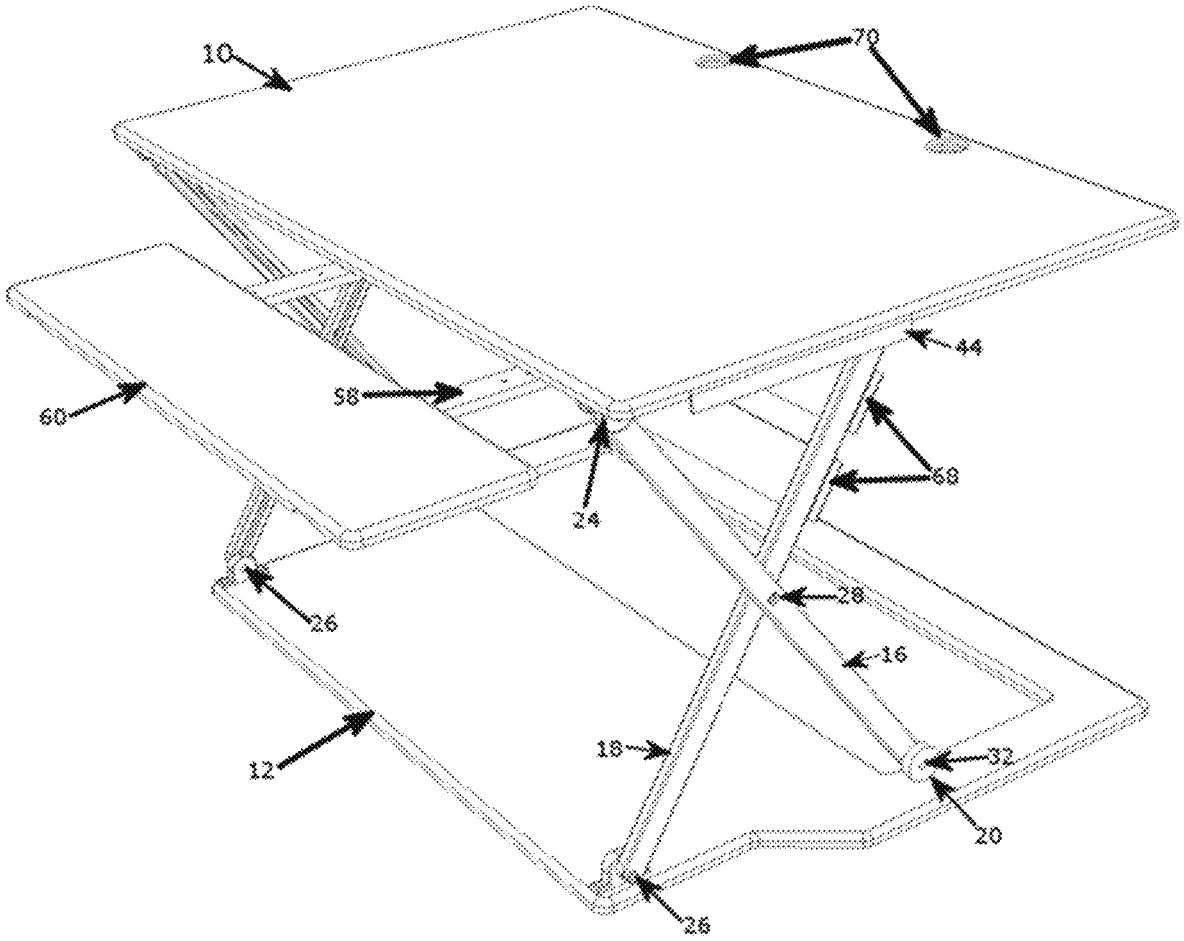
FIG. 1C is a perspective view of an example adjustable desk with alternative sliding mechanisms that incorporate rolling wheels, and a keyboard tray mechanism.
Figure 2:
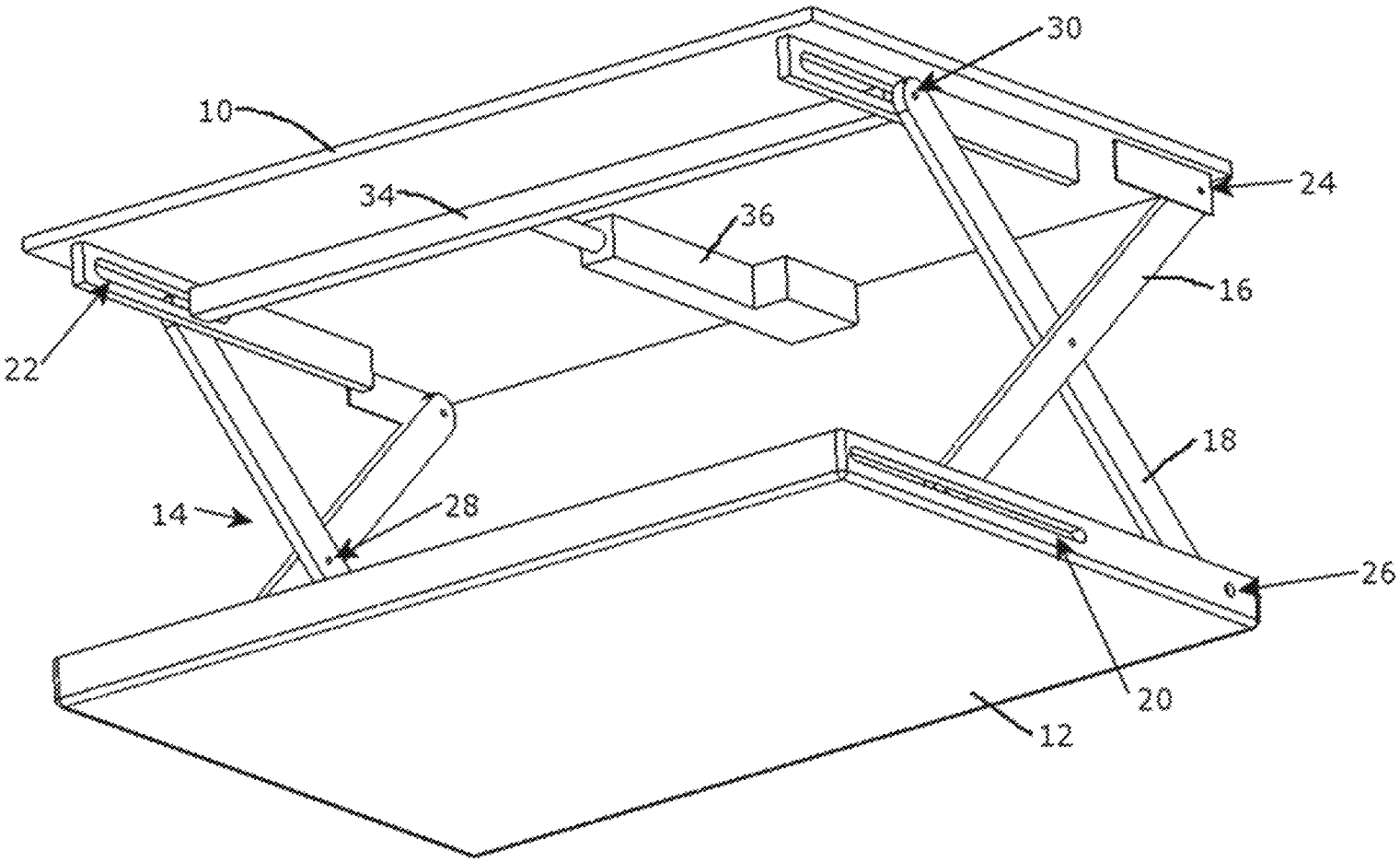
FIG. 2 is a perspective view from another angle of an example adjustable desk including a work surface platform, base, and height adjustment mechanism.
Figure 2B:
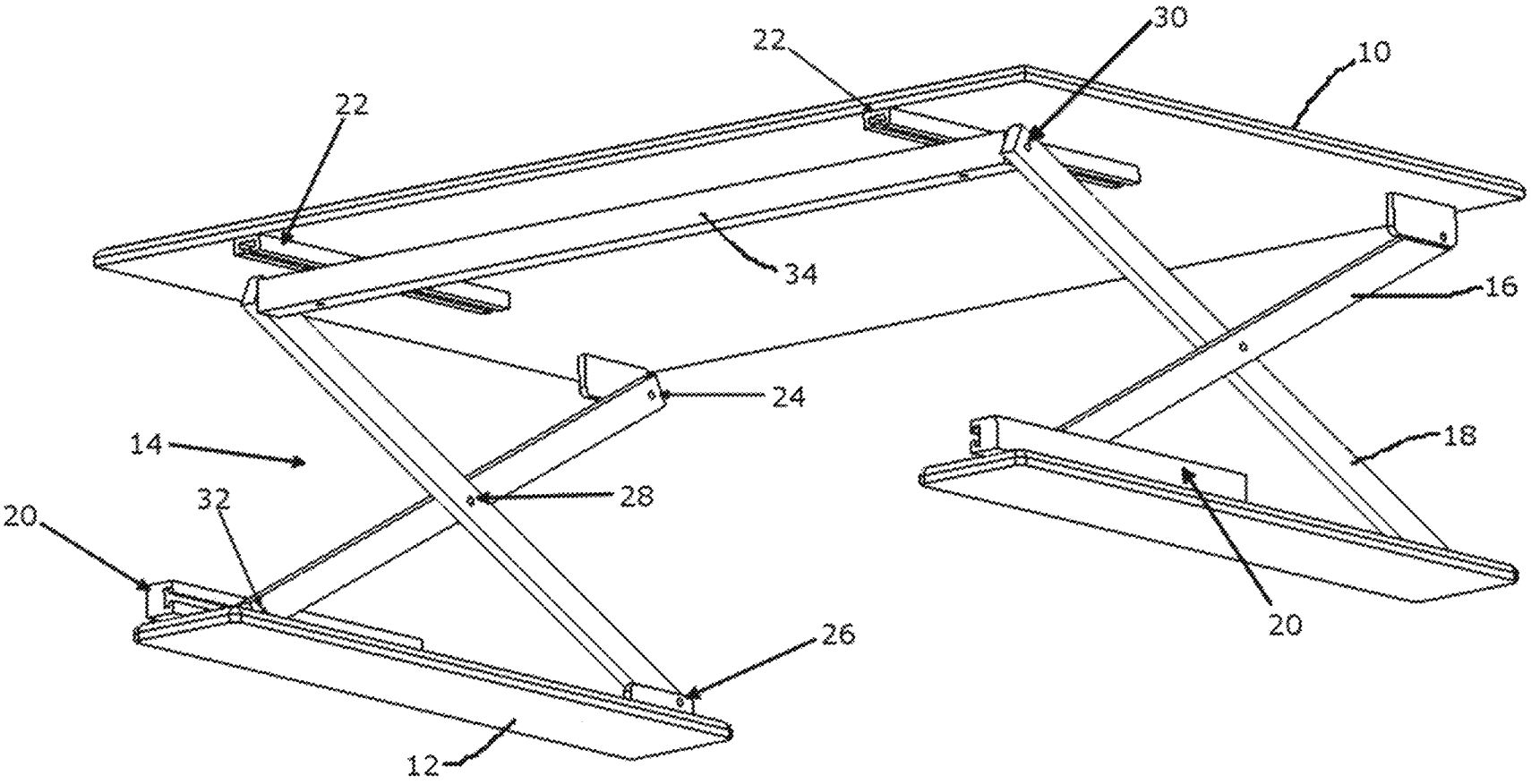
FIG. 2B is a perspective view from another angle of an example adjustable desk including a work surface platform, base, and height adjustment mechanism, with alternative sliding mechanisms.
Figure 2C:
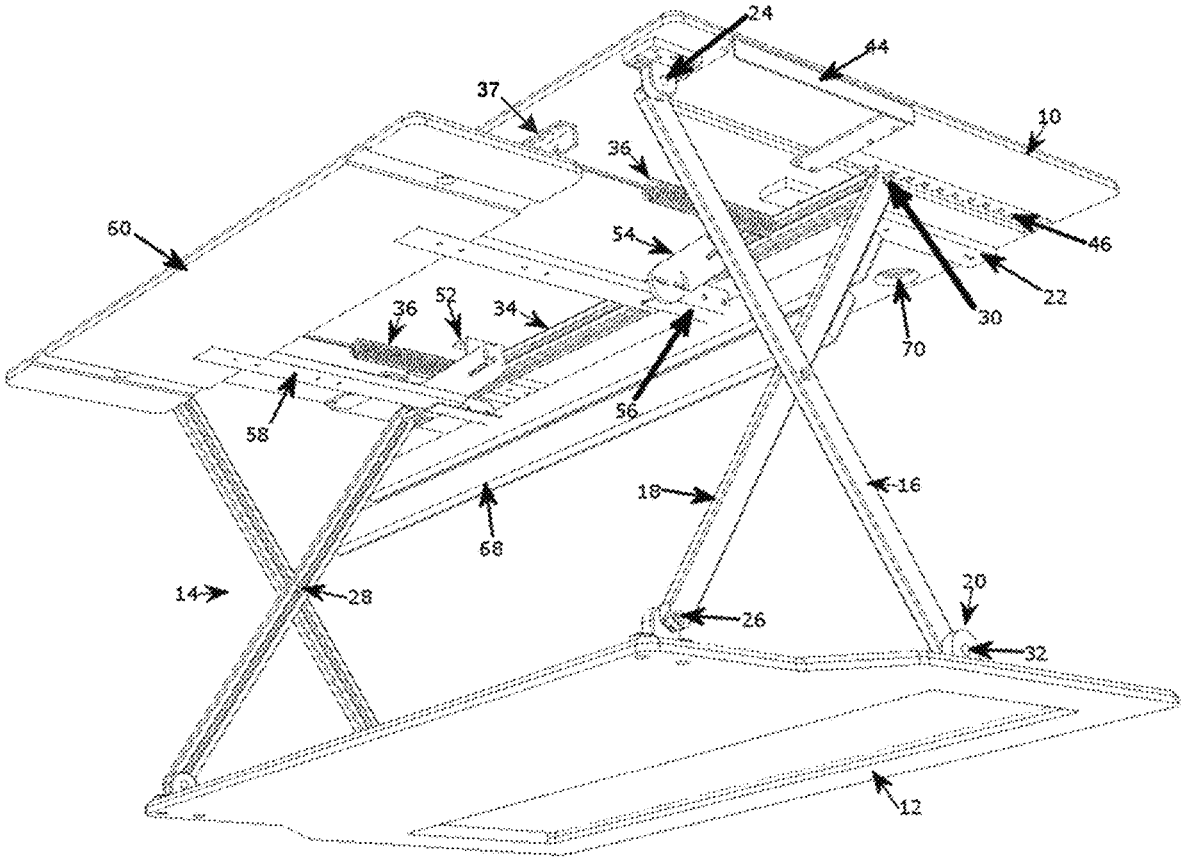
FIG. 2C is a perspective view from another angle of an example adjustable desk with alternative sliding mechanisms that incorporate rolling wheels and a keyboard tray mechanism.
Figure 2D:
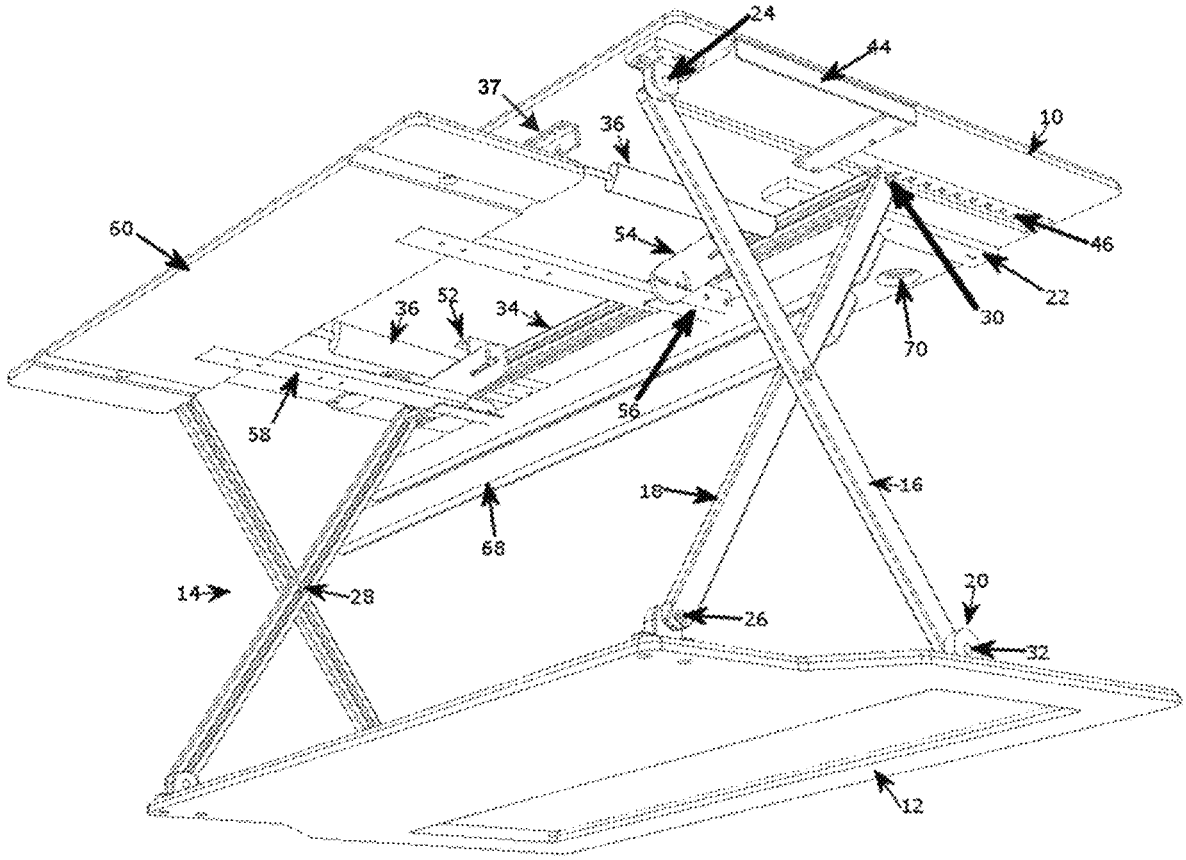
FIG. 2D is a perspective view an example adjustable desk with the alternative sliding mechanisms that incorporates rolling wheels and a keyboard tray mechanism as shown in FIG. 2C, but with gas springs rather than coil springs.
Figure 3:
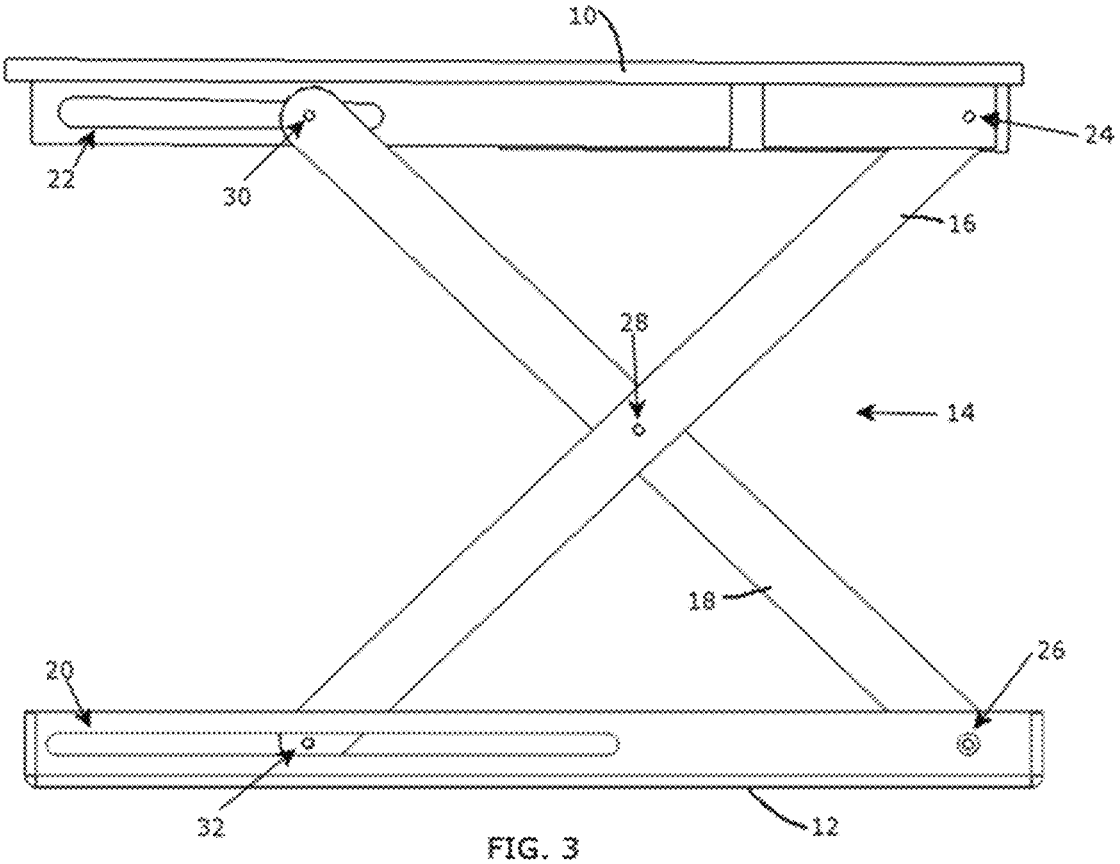
FIG. 3 is a side view of an example adjustable desk including a work surface platform, base, and height adjustment mechanism.
Figure 3B:
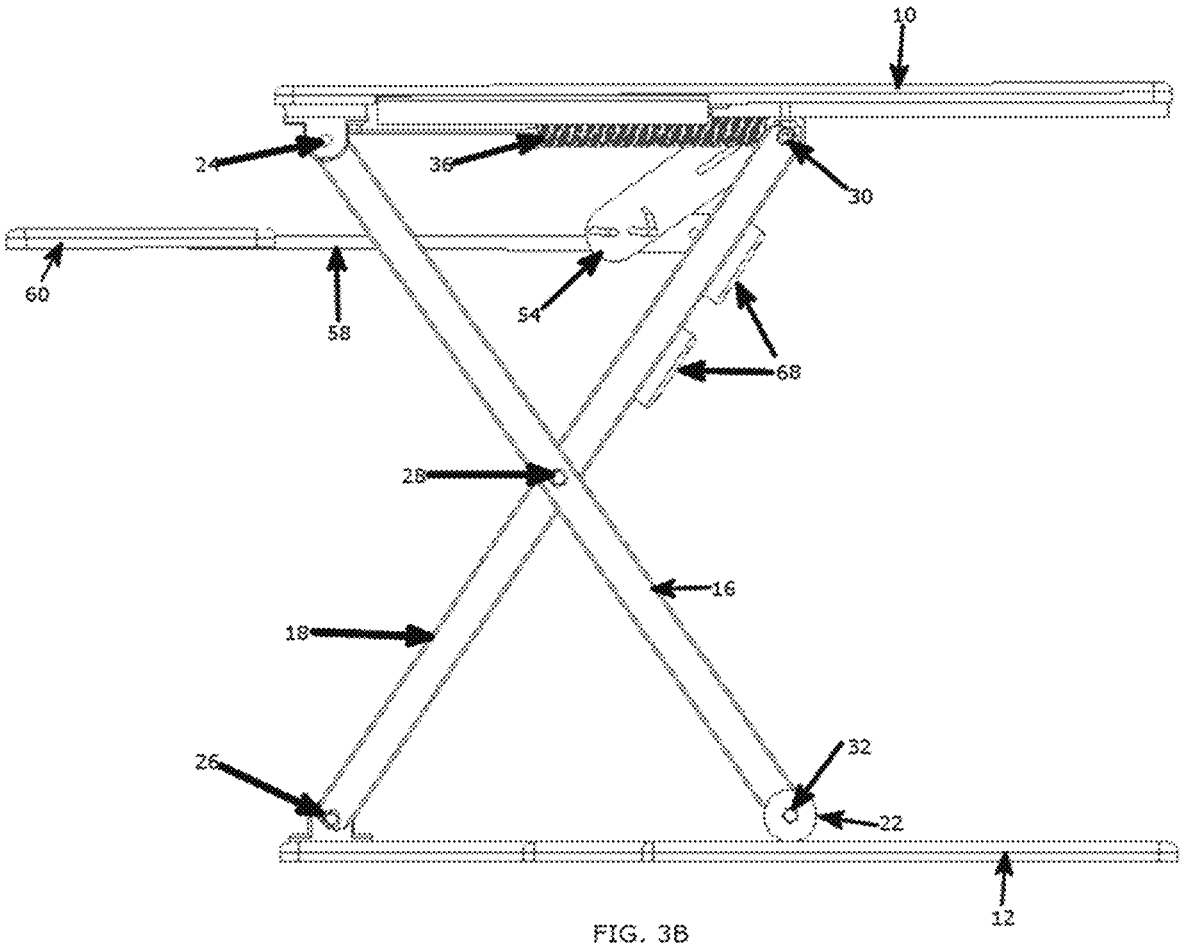
FIG. 3B is a side view of an example adjustable desk including a work surface platform, base, height adjustment mechanism, alternative sliding mechanisms, and a keyboard tray mechanism.

Base 12 is connected to pivot point 26 and sliding mechanism 20. Sliding mechanisms 20 and 22 could also be directly connected to the arm(s) in the form of a slider or wheel, as portrayed in FIG. 1C. The example in FIGS. 1 and 2 shows the present sliding mechanisms 20 and 22 as a groove cut through the wall of the supporting material. FIGS. 1B and 2B show another design of the present sliding mechanisms 20 and 22 as channel or track. FIGS. 1C and 2C show yet another design of the present sliding mechanisms 20 and 22 as a rolling device such as a wheel or bearing. All three are methods to illustrate that there is more than one possible way to accomplish the intended sliding motion. Arm 16 attaches to the sliding mechanism 20 at point 32. Arm 16 moves back and forth along sliding mechanism 20 as part of the scissor motion used to obtain change in height of the work surface platform 10. The sliding action that sliding mechanisms 20 and 22 assist could be accomplished through means other than the illustrated examples, for example, a track system, roller wheel system, or some other means could be used to allow arm 16 and 18 to move in a back and forth motion. This disclosure is not intended to limit the means of the sliding motion, but to establish the fact that the sliding motion is part of the function of the adjustable height mechanism. The mentioned sliding motion is part of the overall scissor motion that is created by the design to vertically raise the work surface platform 10.

Pivot point 26 is the element that attaches the base 12 to arm 18. The examples in FIGS. 1 and 2 shows pivot 26 as being part of the wall of the base, and FIGS. 1B, 1C, 2B, and 2C shows pivot 26 as being a bracket or similar connected to base 12; pivot 26 could be located further in towards the center of base 12 and could be created as a stand-alone element such as a bracket or similar device. Pivot 26 is to be understood as a connection between base 12 and arm 18, and to be a pivot point that allows arm 18 to rotate as part of the scissor motion of height adjustment mechanism 14.

Figure 1D:
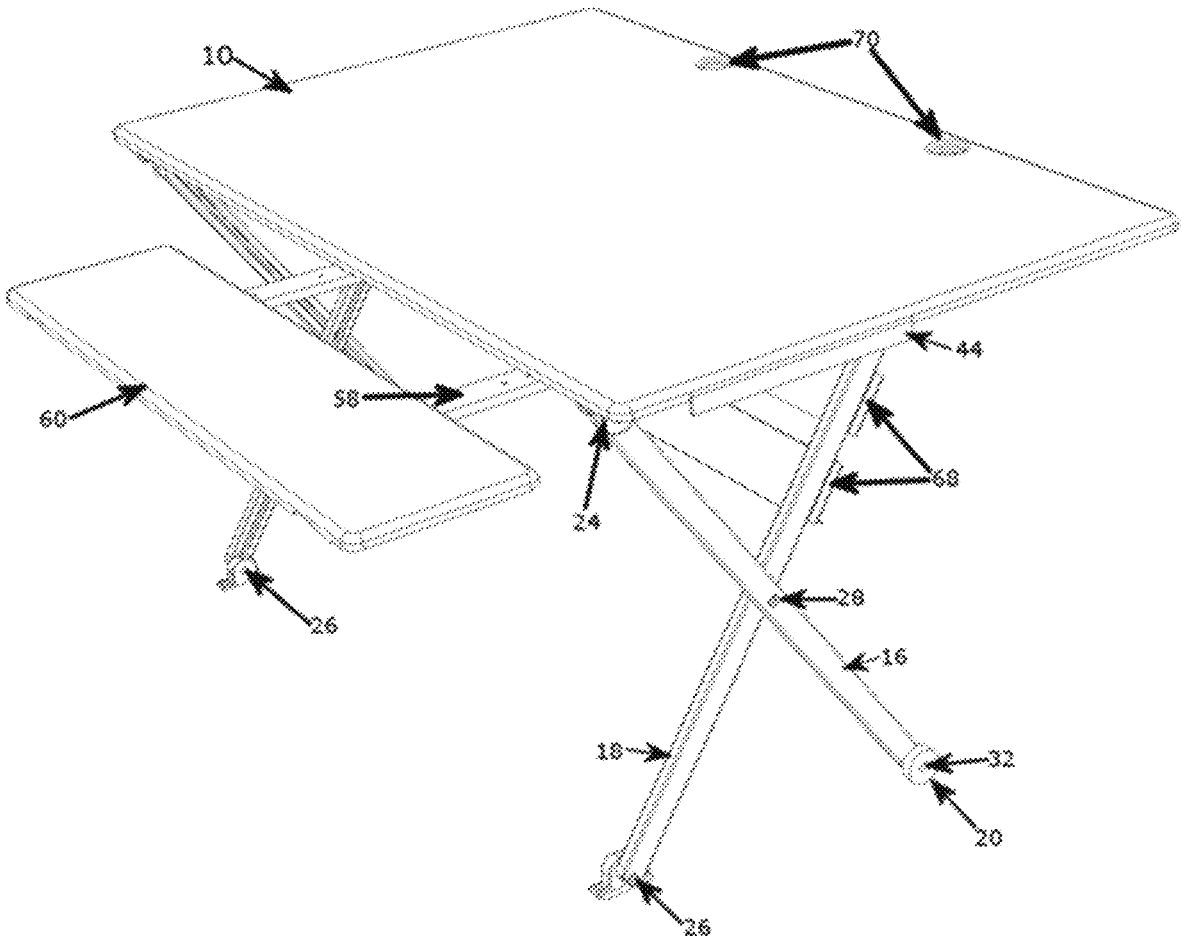
FIG. 1D is a perspective view of an example adjustable desk with alternative sliding mechanisms that incorporate rolling wheels, and a keyboard tray mechanism as shown in FIG. 1C, but without a base.

In some examples, the desktop workspace could exclude base 12, as shown in FIG. 1D. In such examples, height adjustment mechanism 14 connects directly to the desk or surface that the desktop workspace that adjusts vertically is sitting on. The lower portion of arm 18 connects directly to the surface with a pivot point similar to element 26. The lower portion of arm 16 connects to the surface and be guided to slide in a similar motion with an independent sliding mechanism such as, but not limited to, a track, channel, wheel, rail, or slot.

Figure 4:
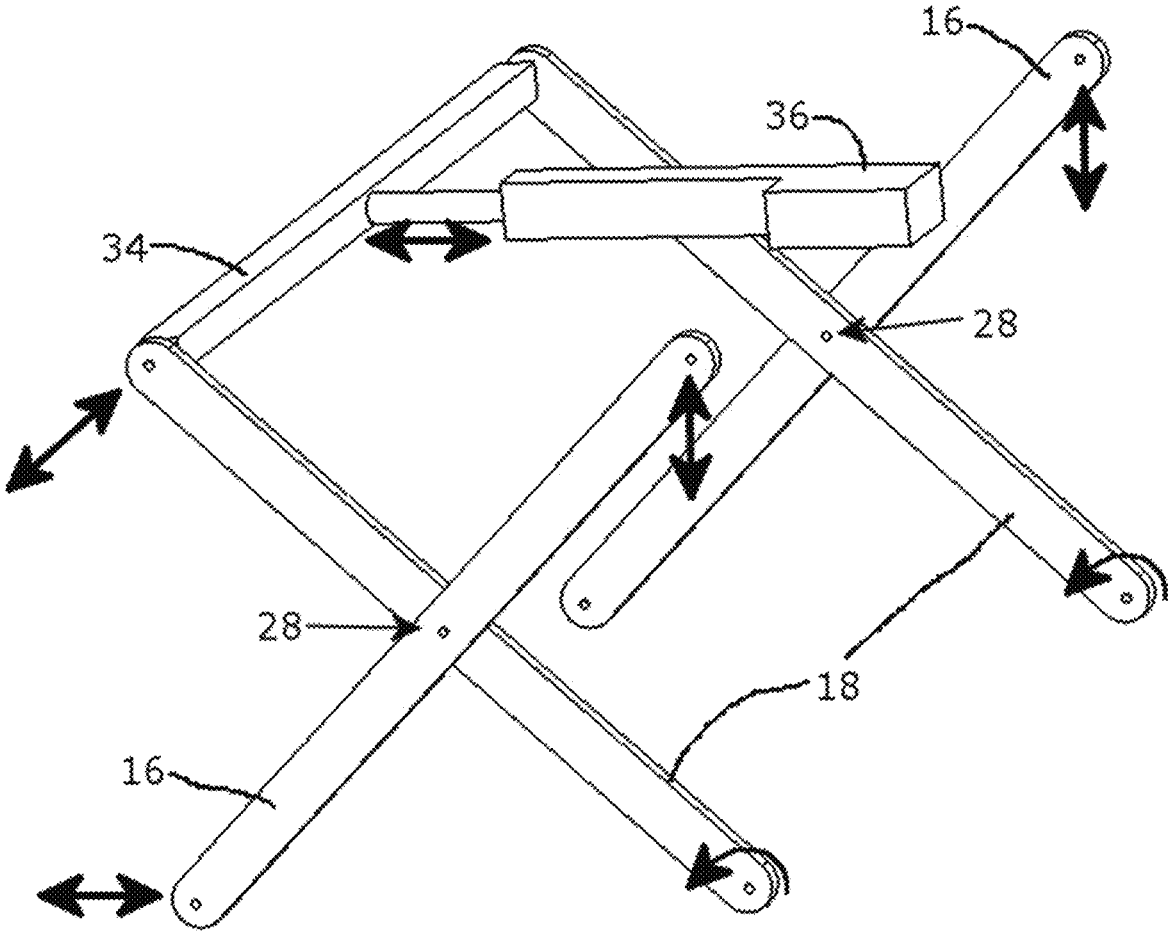
FIG. 4 is a perspective view of an example height adjustment mechanism from FIG. 1.

FIG. 4 shows an example of part of height adjustment mechanism 14, which assists in the vertical motion achieved to move the work surface platform 10 up and down in a smooth motion. Height adjustment 14 is designed so that it creates a vertical motion without any lateral or protruding motion side to side. Said another way, the scissor motion that height adjustment 14 creates allows work surface platform 10 to stay in alignment with base 12 as it raises or lowers. This alignment is intended, however some examples could include a method that does not align element 10 and 12 as raised and lowered.

Figure 7:
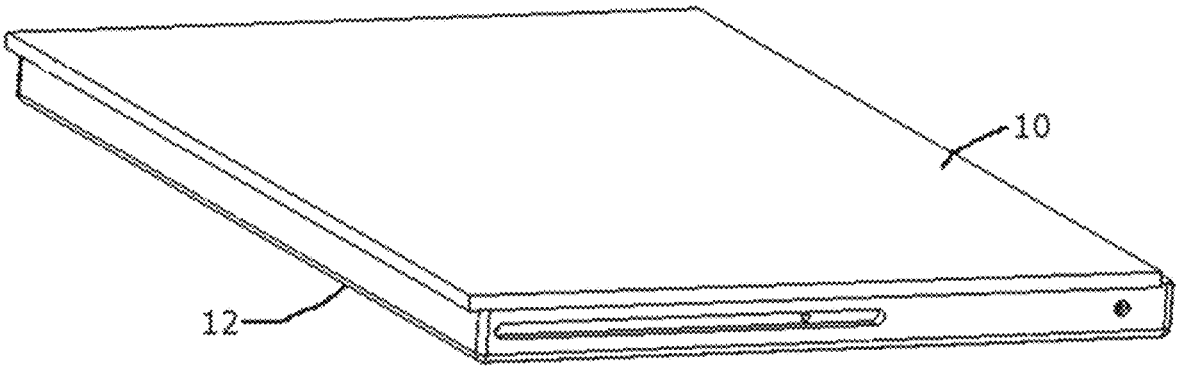
FIG. 7 is a perspective view of an example adjustable desk in a very compact state, with the work surface platform in a completely lowered position.
Figure 7B:
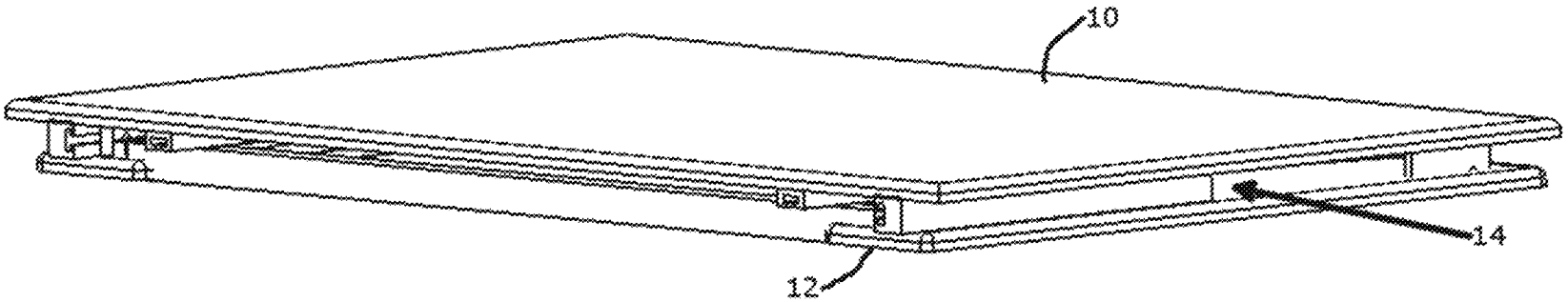
FIG. 7B is a perspective view of an example adjustable desk in a very compact state, with the work surface platform in a completely lowered position, with alternative sliding mechanisms.

Height adjustment mechanism 14 consists of one or more pairs of pivot arms 16 & 18, which have a pivoting point 28 at some point along their axis. Height adjustment mechanism 14 could also include a design where arms 16 & 18 do not actually connect at pivot point 28, but still provide a similar motion. Arm 16 connects at pivot element 24, and at point 32 which slide along sliding element 20. Similarly, arm 18 connects at pivot element 26 and at pivot point 30, which slides along sliding element 22. Height adjustment mechanism 14 also includes components that make the disclosure more rigid, such as cross beam supports labeled as element 68 in FIGS. 1C and 2C. Pivot arms, pivot points, and sliding elements are designed to fit compactly together when the desktop workspace is in a lowered position, as can be seen in FIGS. 7,7B, and 10C. All elements align side-by-side in such a manner that when fully lowered the desktop workspace is very compact, looks sleek, and takes up minimal vertical space. The desktop workspace accomplishes such a compact state by having element 20 and 24 outside arm 16, which is outside arm 18, which is outside element 22. This arrangement of elements allows the elements' to not overlap when desktop workspace that adjusts vertically is in a fully lowered position providing a substantially compact state. The desktop workspace is not limited to specific elements or locations of elements to achieve the height adjustment motion that results in a compact design where elements do not overlap.

The illustrated examples of FIGS. 1 and 1B suggests that pivot points 26 and 24 are located in the back of desktop workspace, and that sliding mechanisms 20 and 22 are located in the front. The illustrated examples of FIG. 1C suggests that pivot points 26 and 24 are located in the front of the desktop workspace and that sliding mechanisms 20 and 22 are located in the back. Some examples include a design where the pivot points and sliding mechanisms are at opposite sides, or some combination of both.

Figure 4B:
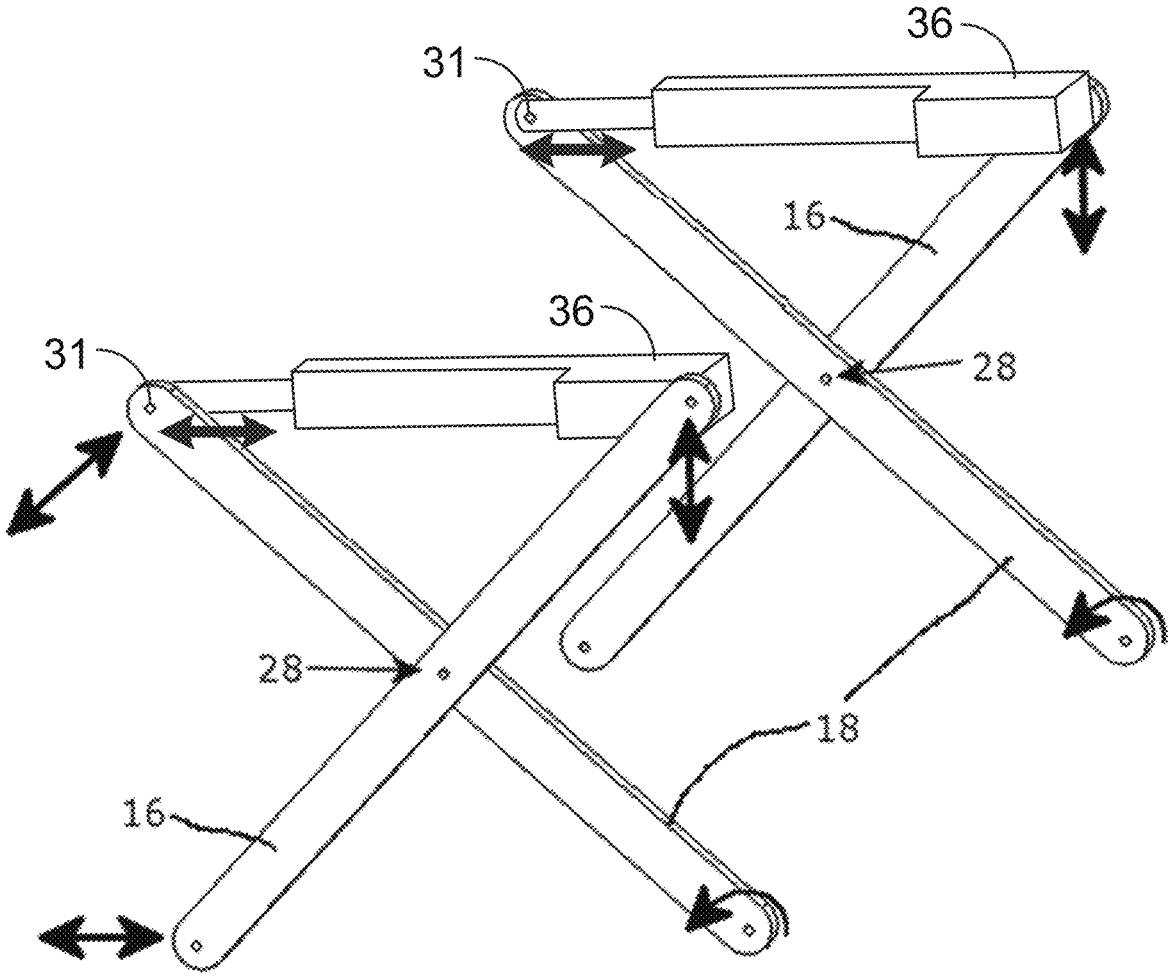
FIG. 4B is a perspective view of an example height adjustment mechanism as shown in FIG. 4, but without a cross beam.
Figure 4C:
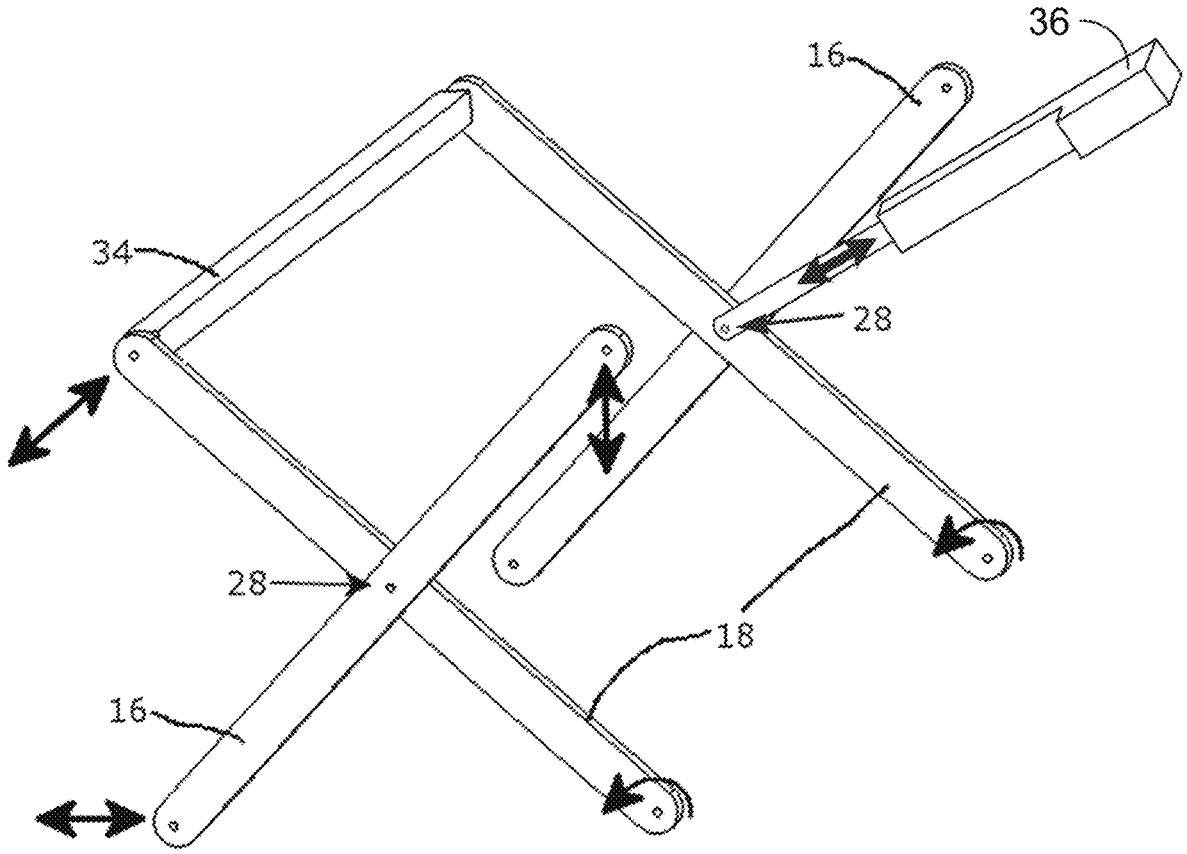
FIG. 4C is a perspective view of an alternative height adjustment mechanism to that shown in FIG. 4.
Figure 4D:
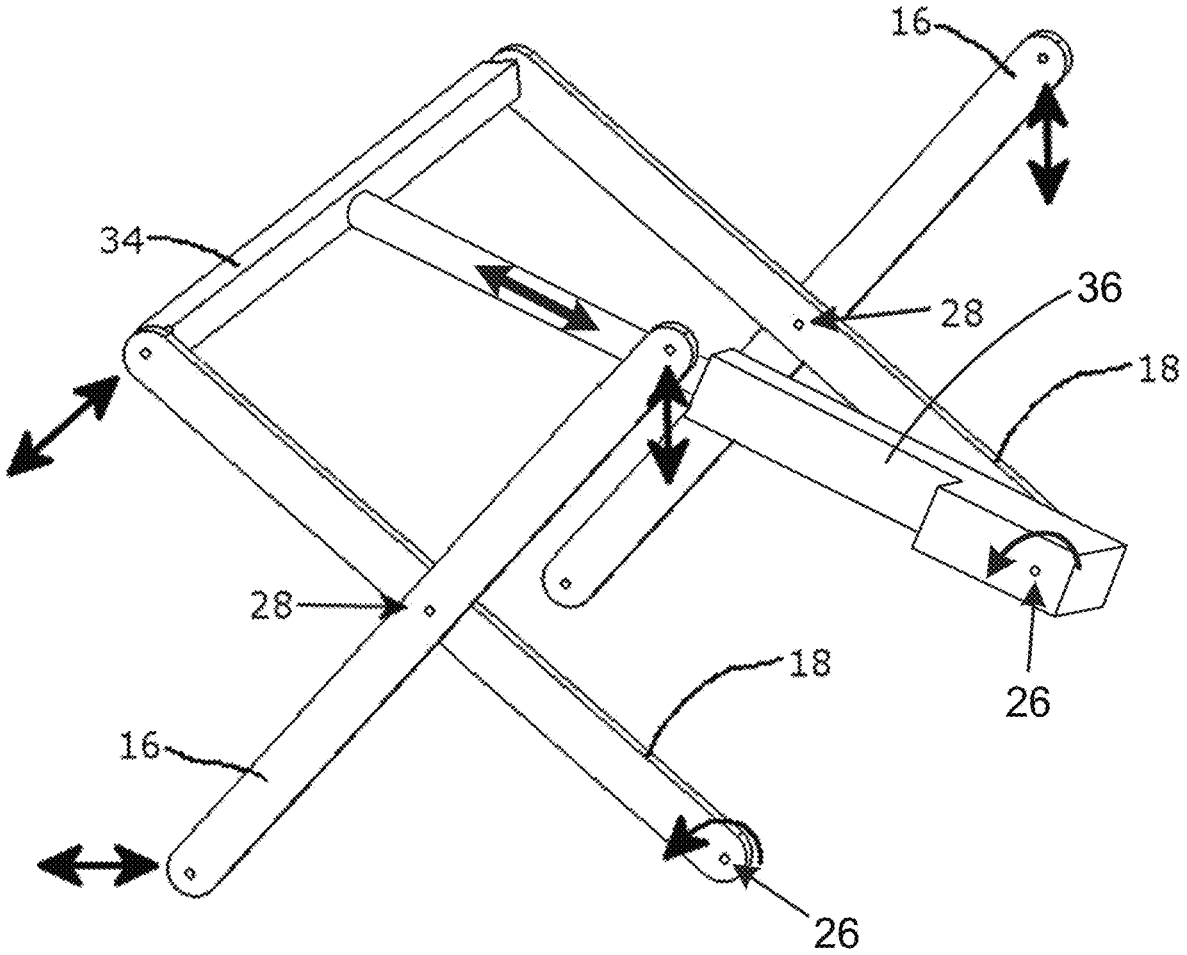
FIG. 4D is a perspective view of an alternative height adjustment mechanism to that shown in FIG. 4.
Figure 4E:
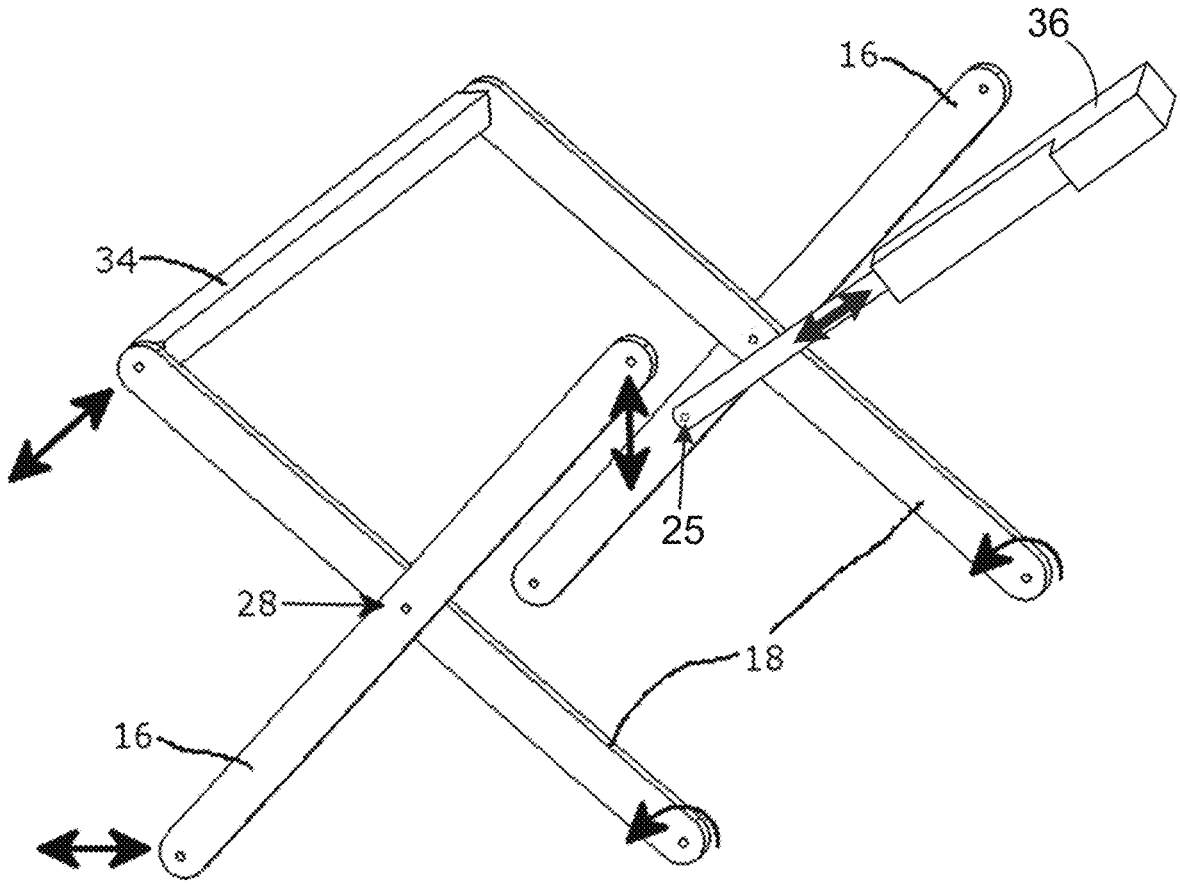
FIG. 4E is a perspective view of an alternative height adjustment mechanism to that shown in FIG. 4.
Figure 4F:
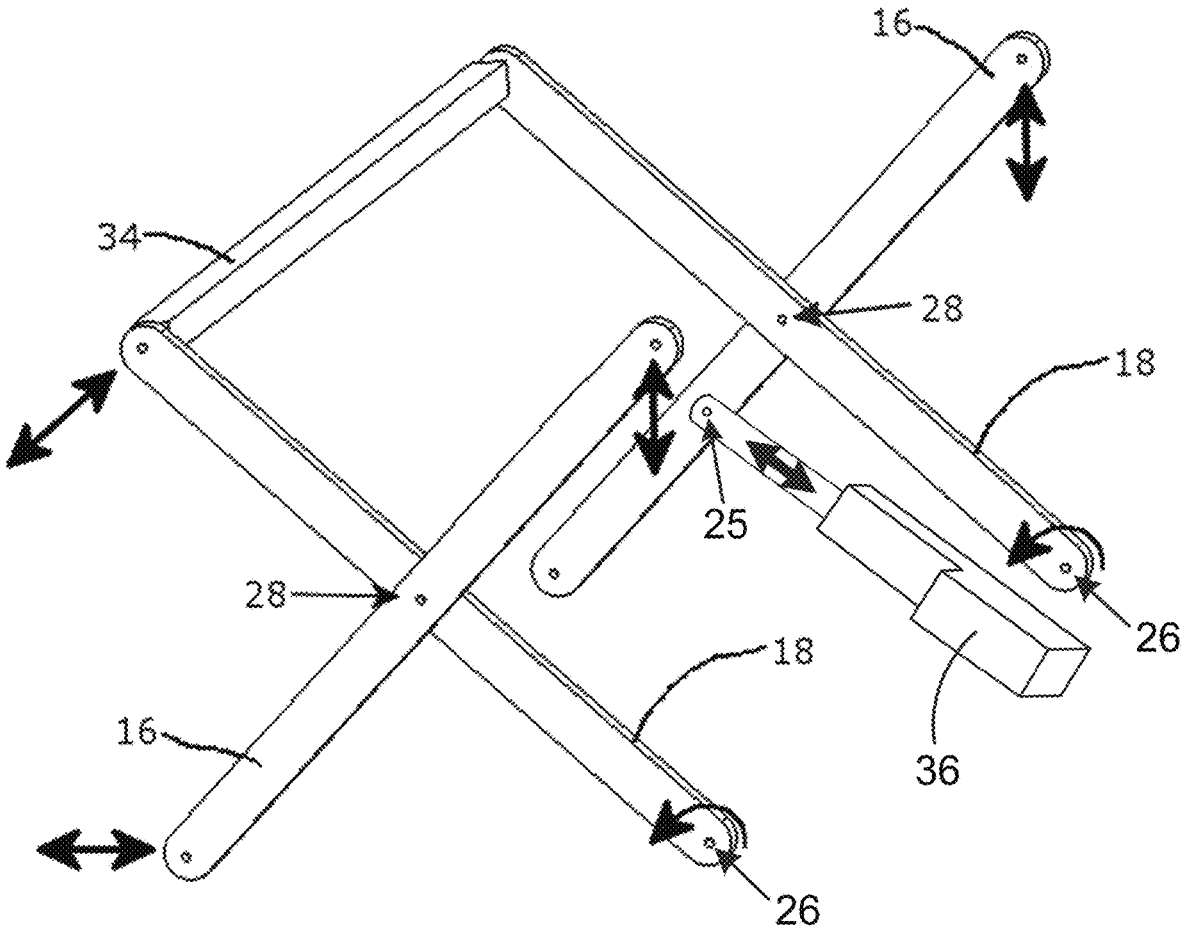
FIG. 4F is a perspective view of an alternative height adjustment mechanism to that shown in FIG. 4.

As can be seen in FIGS. 2, 2B, 2C, 4, 5B, and 5C pivoting arms, are attached to a cross beam 34. Cross beam 34 assists in stabilizing the invention and assist all elements of the height adjustment mechanism to move in concert when a force is applied. The force can be applied from various methods and on various points of cross beam 34, pivot arms 16 & 18, pivot elements 26 & 24, or sliding mechanisms 20 or 22. FIG. 4D is a perspective view of an example height adjustment mechanism as shown in FIG. 4, but with element 36 connected on a point of cross beam 34 to one of pivot elements 26. FIG. 4E is a perspective view of an example height adjustment mechanism as shown in FIG. 4, but with element 36 connected to one of pivot arms 16 via an arm pivot 25. FIG. 4F is a perspective view of an example height adjustment mechanism as shown in FIG. 4, but with an upwardly extending element 36 connected to one of pivot arms 16 via an arm pivot 25. Some examples include a design where element 34 does not span across the mechanism connecting all or some of the arms.

FIG. 4 shows the force being applied by element 36 to cross beam 34. Element 36 can apply a pushing and pulling force to cross beam 36, which causes pivot arms 16 and 18 to move in a scissor motion. The example is intended to suggest that element 36, which applies force to height adjustment mechanism 14, can be a variety of different mechanisms, elements, or represent manual human force. For example, the force that element 36 provides could come from; a linear actuator, AC or DC motor, human force, gravity, springs, other objects with kinetic energy, or another source of force. For example, FIG. 4 illustrates element 36 as a linear actuator, while FIG. 5C illustrates element 36 as a pair of springs.

The combination of height adjustment mechanism 14 and a force represented by element 36, create the scissor motion that moves the work surface platform vertically up and down. Examples portrayed in FIGS. 4, and 5 show the scissor motion of height adjustment mechanism 14.

Examples can utilize element 36 or similar element in a different location; for example, the element could attach directly to arms 16 or 18, or to one of the pivot points, instead of to element 34. Some examples may not include element 34 or the like, where such a crossbeam or connection is not deemed necessary. FIG. 4B is a perspective view of an example height adjustment mechanism as shown in FIG. 4, but without a cross beam 34. In FIG. 4B, elements 36 attach directly to arms 18 through arm pivot points 31, instead of to element 34. FIG. 4C is a perspective view of an example height adjustment mechanism as shown in FIG. 4, but with element 36 connected to one of the scissoring pivot points 28 instead of to cross beam 34.

Figure 5:
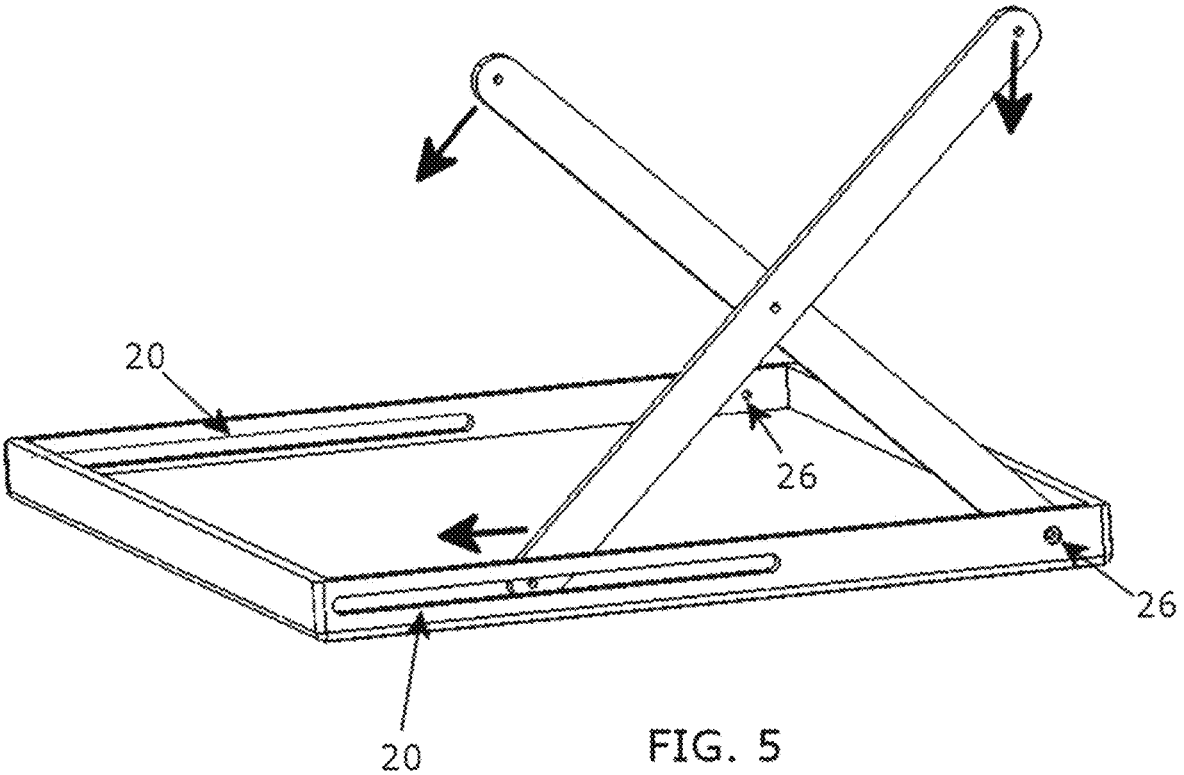
FIG. 5 is a perspective view of parts of an example adjustable desk including sliding mechanism locations and pivot points of this disclosure from FIG. 1.
Figure 5B:
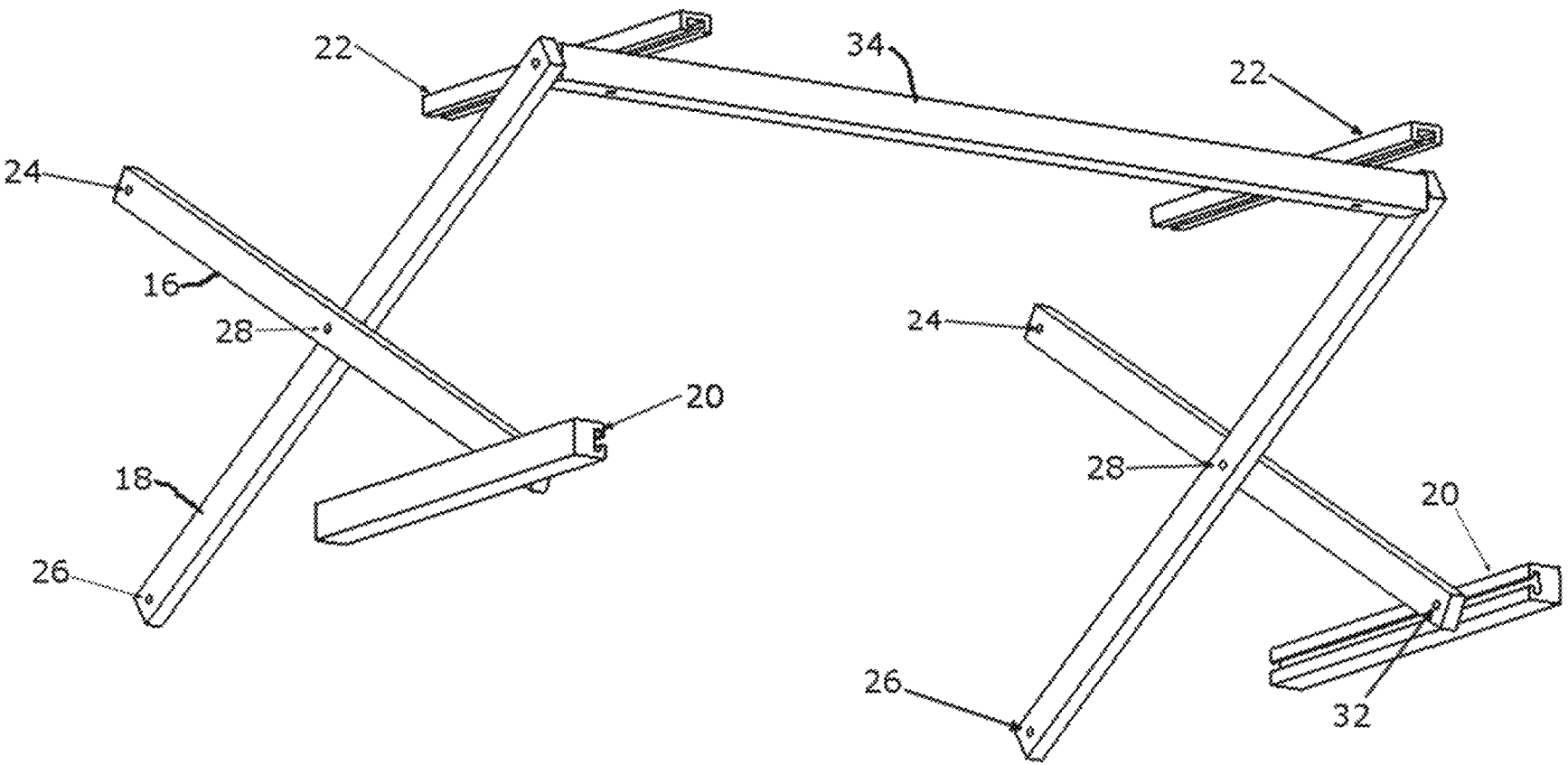
FIG. 5B is a perspective view of parts of an example of a height adjustment mechanism of this disclosure from FIGS. 1 and 1B with alternative sliding mechanisms.
Figure 5C:
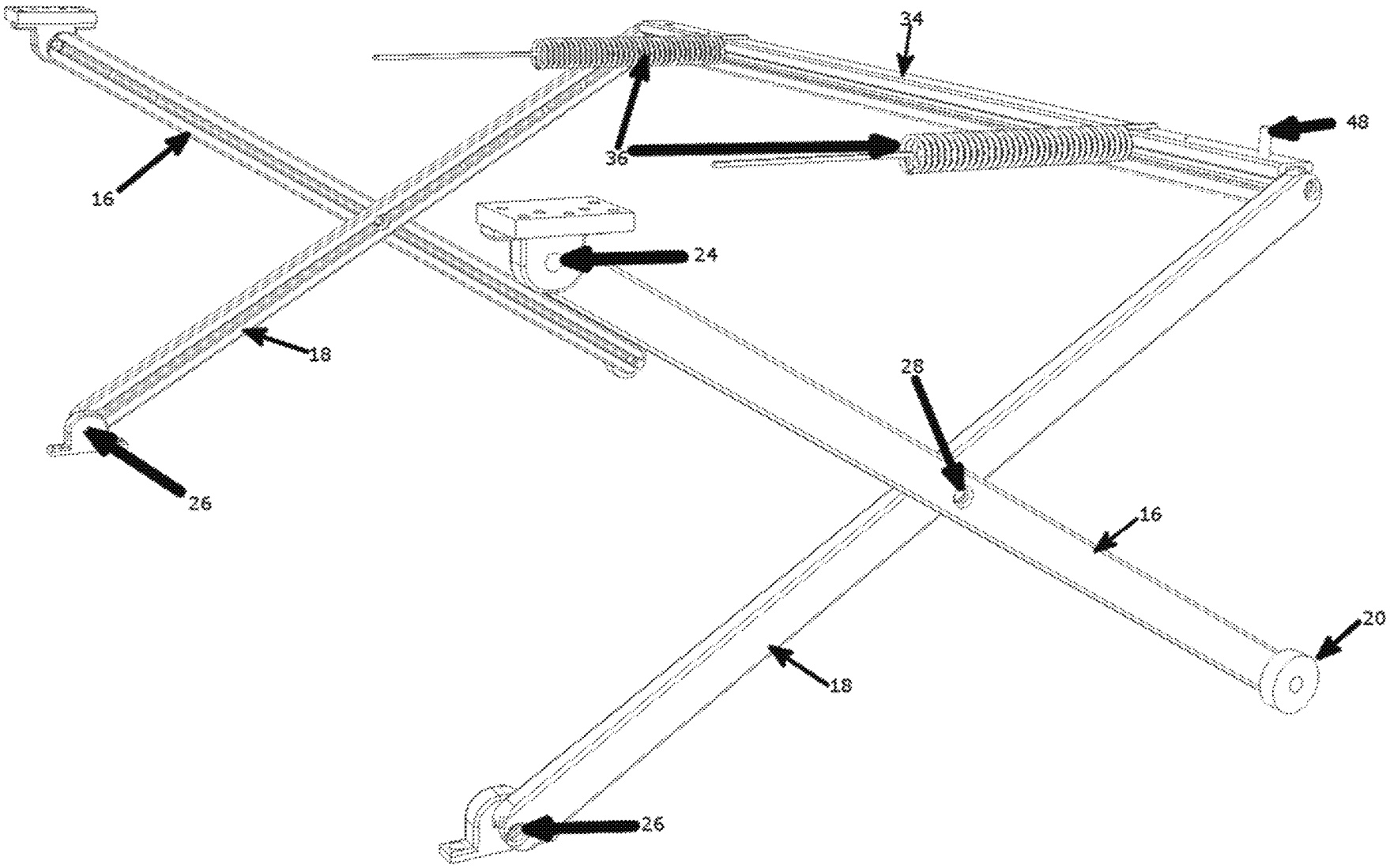
FIG. 5C is a perspective view of parts of an example of a height adjustment mechanism from FIGS. 1 and 1B with alternative sliding mechanisms.

Examples in FIGS. 4, and 5 include arrows that show some of the possible motions of mechanism 14. Pivot arms are connected to one another at pivot point 28. As one end of arm 16 moves along sliding mechanism 20, the other end of the arm moves up or down vertically. When arm 18 pivots at point 26, the other end of the arm slides along sliding mechanism 22, which can be seen in FIGS. 2, 2B, and 2C and moves up and down vertically.

Figure 5D:
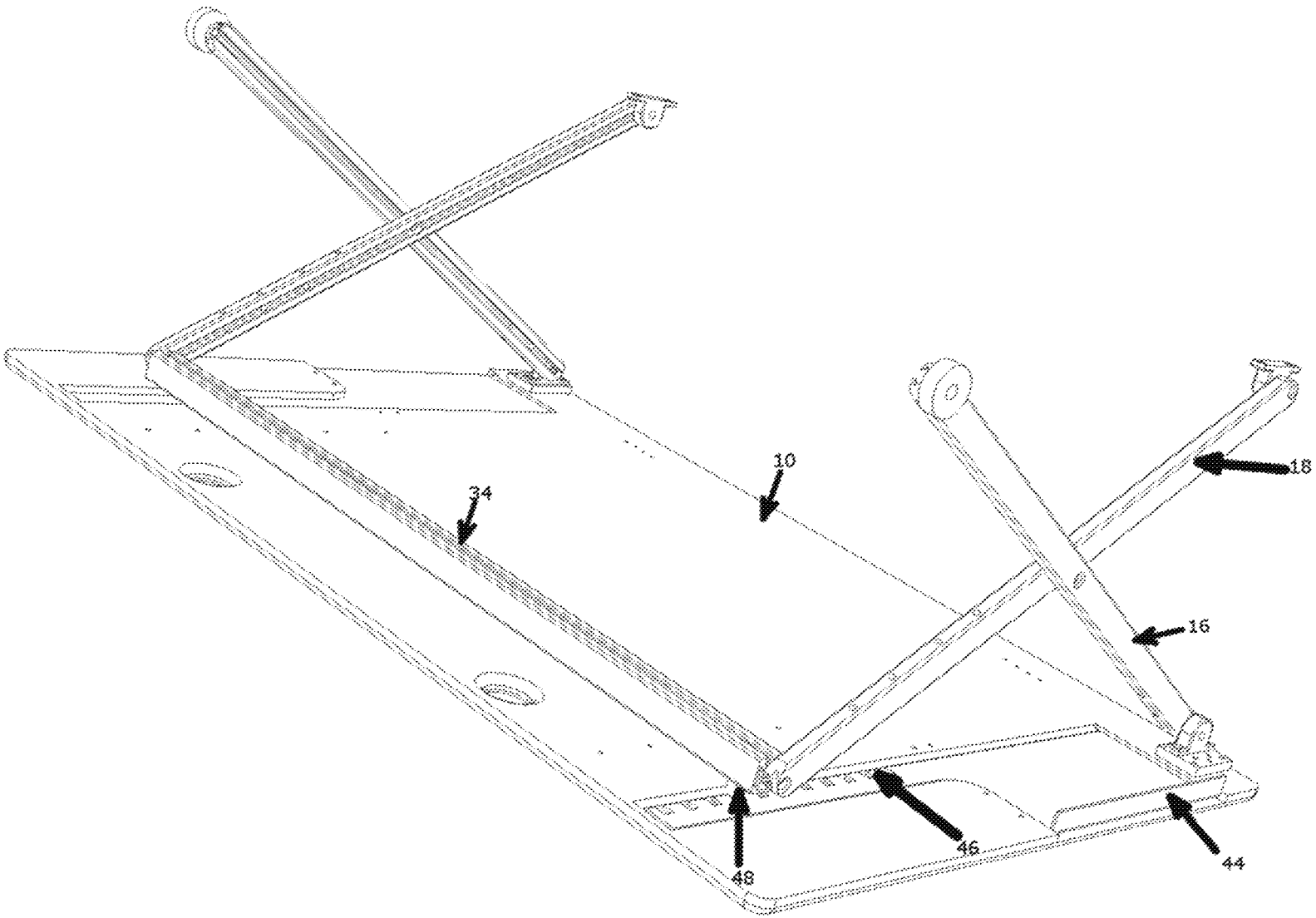
FIG. 5D is a perspective view of parts of an example of a height adjustment mechanism and locking mechanism from FIG. 1C.
Figure 6:
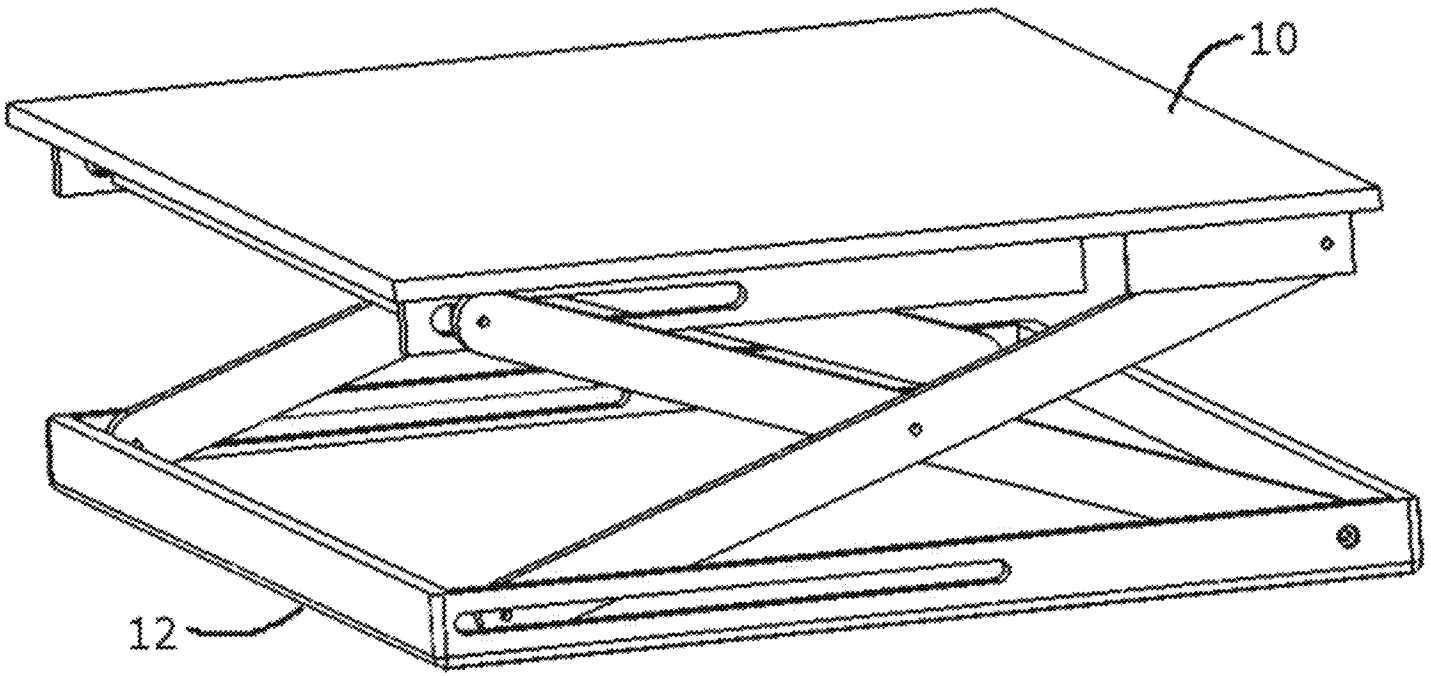
FIG. 6 is a perspective view of an example adjustable desk wherein the work surface platform is in a partially raised state.
Figure 6B:
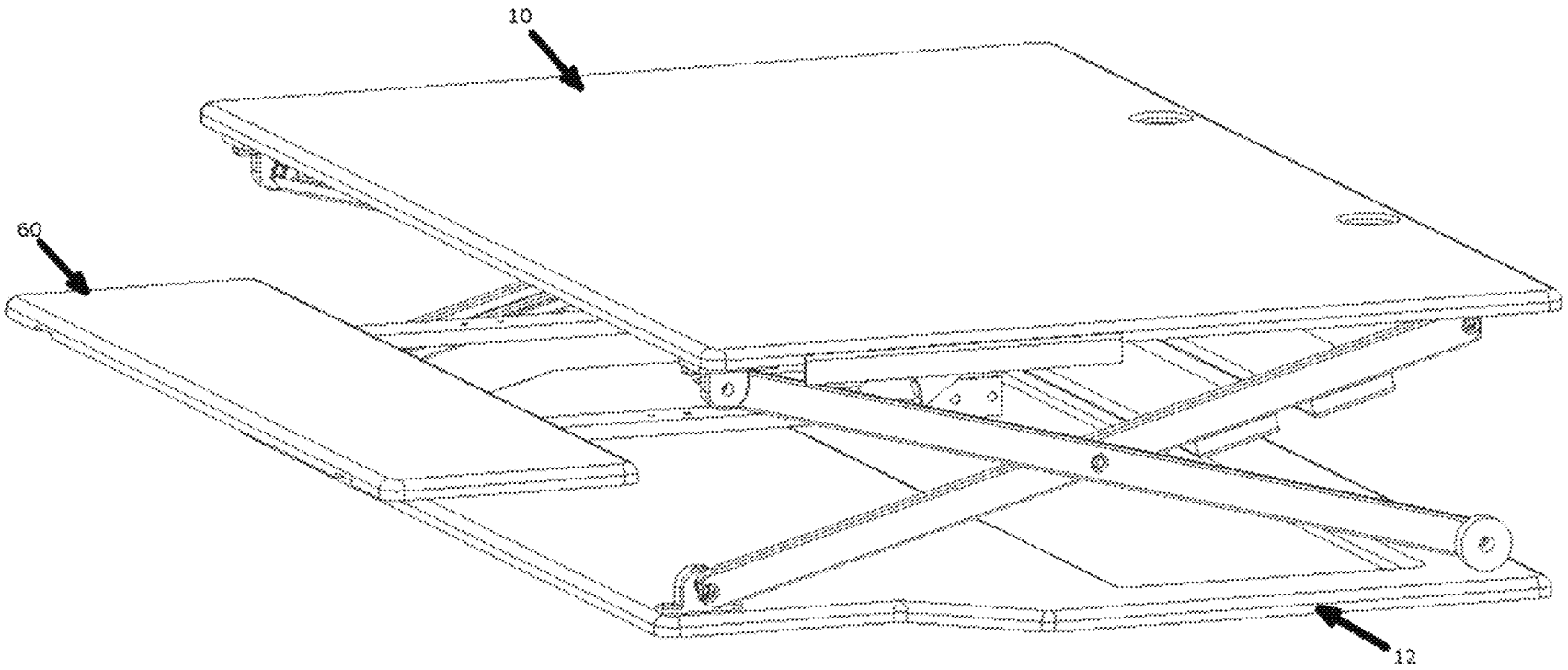
FIG. 6B is a perspective view of an example adjustable desk where the work surface platform is in a partially raised state with an example keyboard tray mechanism.

The height adjustment mechanism moves vertically and is held or locked into position at various heights. Examples of the height adjustment mechanism use various methods to lock or hold in place. For example, element 36 acts as the locking device, or the locking device can be included in sliding mechanism(s) 20 & 22, or the locking device can be included in pivot point(s) 26 and 24, or the locking mechanism could entail another element not mentioned. FIG. 5D portrays a locking device that could include element 34 or other element engaging with element 44. Pins or other element, portrayed as element 48, engage with teeth or other element, portrayed as element 46 to lock the height adjustment mechanism in a desired position. The locking element can include, but not limited to, a linear actuator, a motor, applied pressure, locking teeth, or some other method to prevent arms 16 and 18 from moving, so that work surface platform 10 does not change vertical height. Applications utilizing a linear actuator or similar can allow the operator to adjust the height without the limitations of preset heights that some locking mechanisms only provide. Instead of preset heights created by an element with features such as preset holes, the linear actuator or something similar would allow the operator to set the height limit by stopping the linear actuator or similar at any point the operator chooses. The desktop workspace includes a locking mechanism that maintains the vertical position of surface 10; the examples are not limited to specific elements to achieve the height locking function.

Examples include a means to unlock the device so that the work surface platform 10 can change height. Examples can include, but not limited to, a button(s) to control a motor or the like, a handle that the user pulls on to unlock the device, or another device that unlocks the locking device. FIG. 5D portrays an example of a locking mechanism where element 44 acts as a handle that once pressure is applied to can both lock and unlock the height adjustment mechanism by engaging or disengaging the teeth, element 46 or similar to pin, element 48 or similar. Unlocking elements are suggested, however, examples are not limited to specific elements to achieve the unlocking function.

The example shows sliding element(s) 22 and pivot element(s) 24 connect the height adjustment mechanism 14 to the work surface platform 10. The example allows for the work surface platform to be raised and lowered, as well as locked into the desired position of the individual using the desktop workspace. This allows the user to utilize the desktop workspace that adjusts vertically while in a seated position or a standing position.

Figure 8:
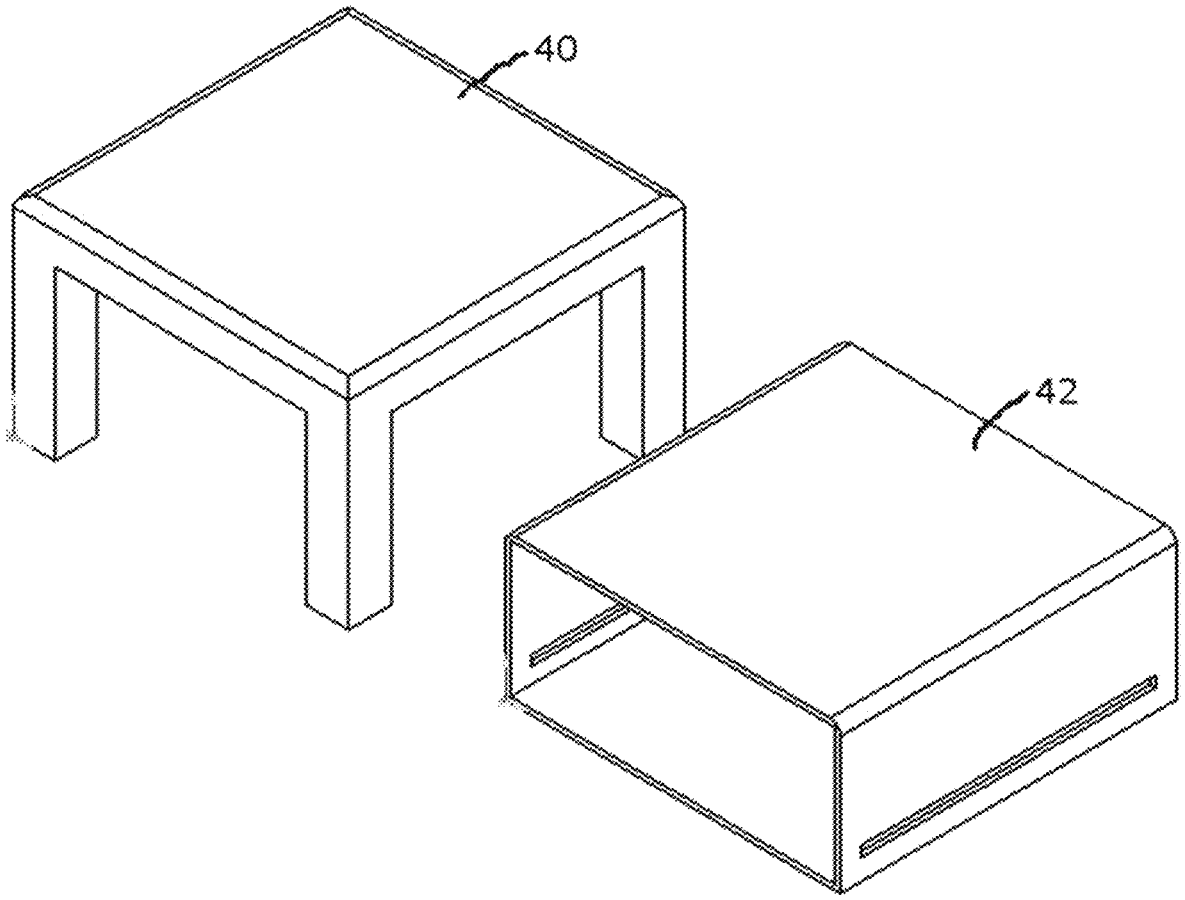
FIG. 8 is a perspective view of example elements intended to additionally raise the height of monitors or other items.
Figure 9:
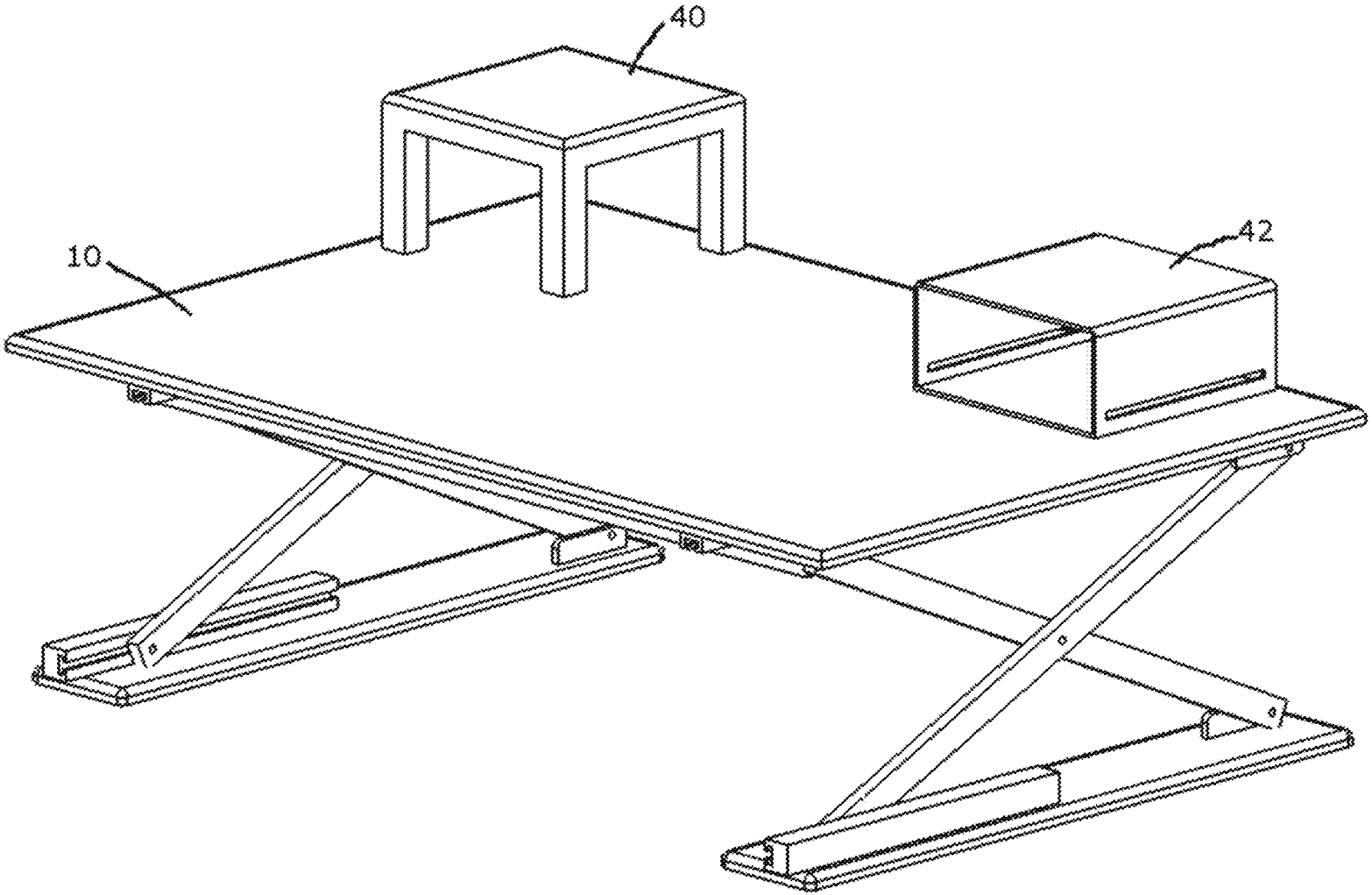
FIG. 9 is a perspective view of an example adjustable desk with monitor raising elements resting on top of the work surface platform.

FIG. 8 portrays the current design of elements 40 and 42, which could be used to elevate a monitor, laptop, or other items to a level higher than that of work surface platform 10. Additionally raising a monitor can create a more comfortable and healthier work space for the operator by bringing their screen(s) to a position closer to eye level. FIG. 9 shows elements 40 and 42 sitting on work surface platform 10. Elements 40 and 42 are presently designed to be able to sit anywhere on surface 10. Examples are not intended to limit the design of elements 40 and 42. Elements 40 and 42 are intended to represent a method in which a monitor(s) can be elevated to height higher than if it were sitting on work surface platform 10. It is to be understood that element 40 or 42 could be designed differently and still accomplish its function to raise the height of a monitor(s) or other items.

Figure 10:
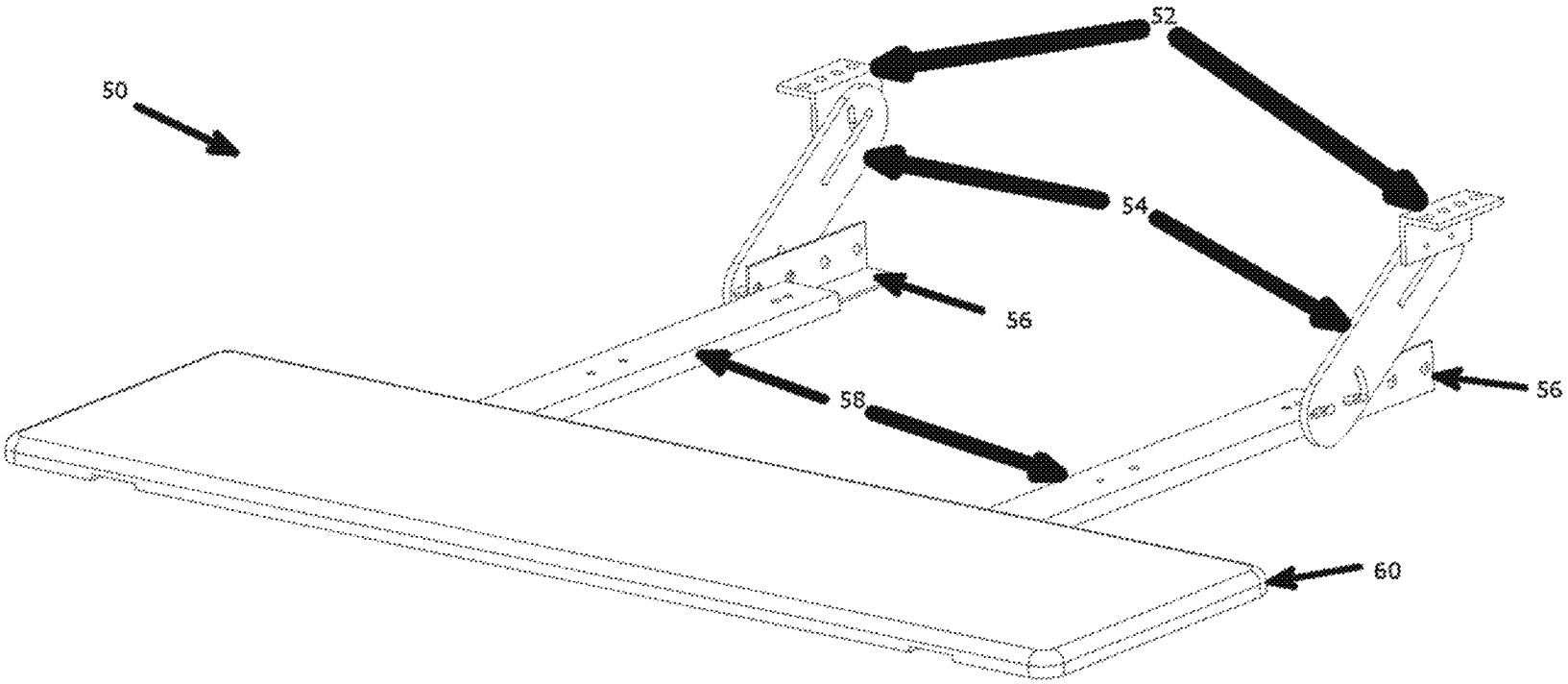
FIG. 10 is a perspective view of parts of an example of a keyboard tray mechanism.
Figure 10B:
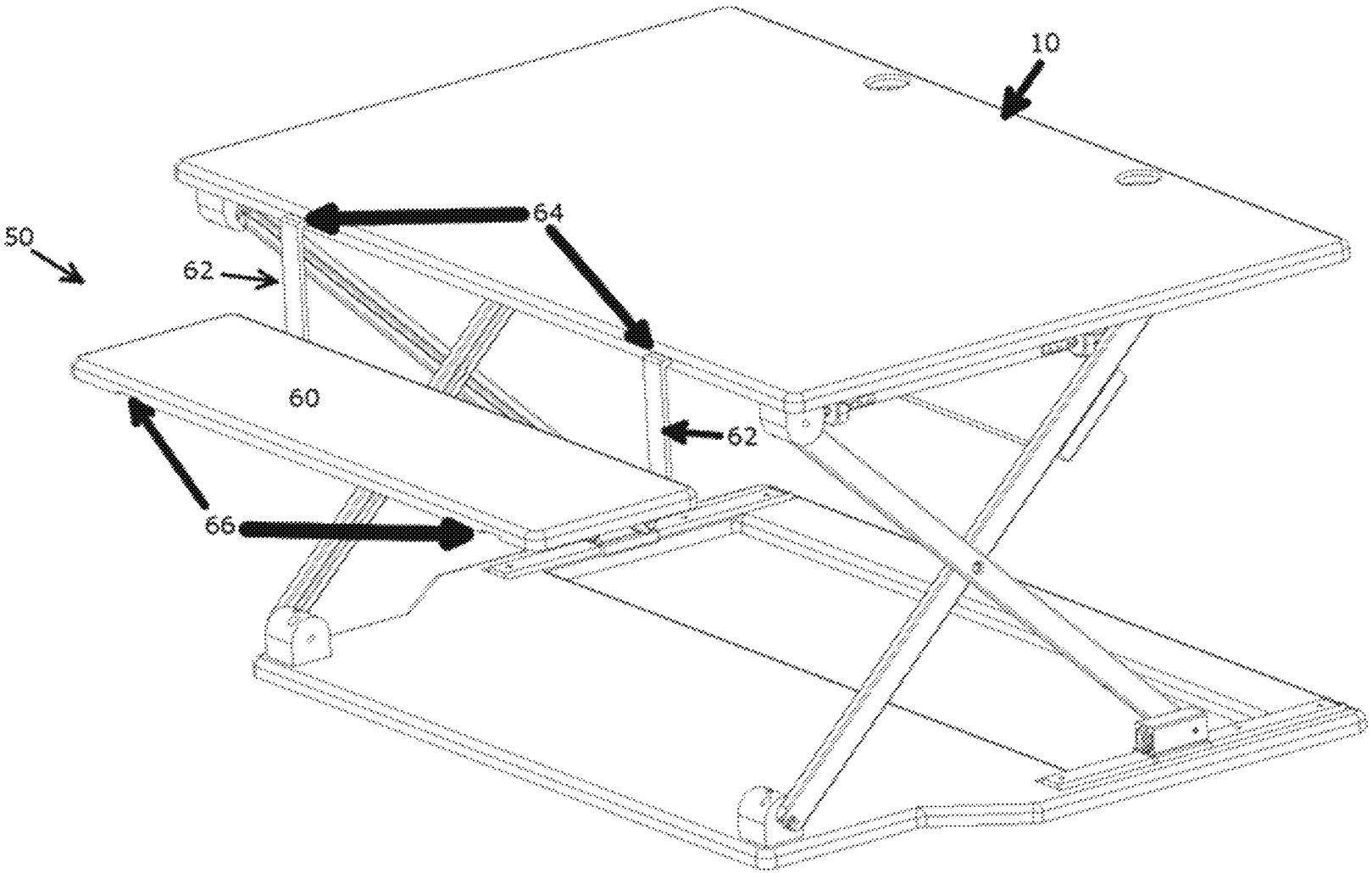
FIG. 10B is a perspective view of an example adjustable desk with an alternative keyboard tray mechanism attached.
Figure 10C:
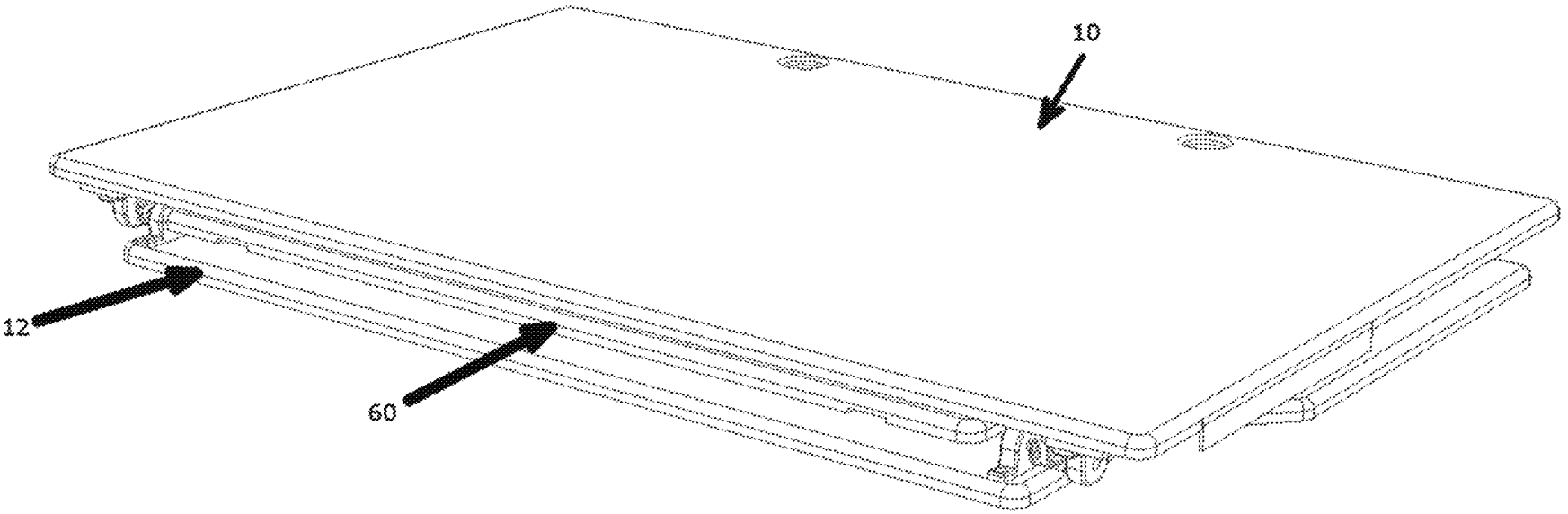
FIG. 10C is a perspective view of an example adjustable desk with keyboard tray mechanism attached and in a closed position.

FIGS. 10, and 10B show an example of part of keyboard tray mechanism 50, which provides a platform for the user to place items such as a keyboard, mouse, or other items on. Keyboard mechanism 50 is configured move to a position that is in an outward and lowered position with respect to surface 10. Such a position can provide a more ergonomic location of the keyboard and mouse for the user. Some examples include a design where the keyboard tray can be removed, adjusted, or designed so that it extends out when is in use and is compactly stored under surface 10 when not in use.

FIGS. 10 and 10C show an example of Keyboard tray 50 where it is configured to move underneath and flush with surface 10 to allow this disclosure to maintain its compact state once in a closed position. Bracket 52 connects to channel plate component 54, which connects to bracket 56, which connect to slider 58, which connect to keyboard platform 60. When the user applies an inward and upward force to platform 60, channeled plate component 54 and slider 58 allow the keyboard tray mechanism to move to a position that is compactly positioned underneath platform 10 as portrayed in FIG. 10C. Conversely, when an outward and downward force is applied to platform 10, elements 52, 54, 56, and 58 allow mechanism 50 to be in an out and down position as portrayed in FIGS. 1C and 2C. Said more specifically, plate 54 contains channels or grooves that guide brackets 52 and 54 connect to with pins, screws, or similar. When the user pulls or pushes up, down, in, or out on the platform 60, the channels or grooves in plate 54 along with the sliding motion of slider 58 guide the platform to either rest in an outward state for typing or tucked away under the work surface platform 10.

FIG. 10B shows an example of keyboard tray mechanism 50 that attach to platform 10. Bracket 62 attaches to platform 10 at element 64 and keyboard platform 60 at element 66. Element 64 and 66 consists of a channel, bracket, or other means to attach bracket 62 to both platform 10 and platform 60.

Elements for keyboard tray mechanism 50 are suggested, however, examples are not limited to specific elements to achieve the function of the keyboard tray mechanism.

The intention of the different examples discussed is not intended to limit the scope of this disclosure. The description and terminology is not intended to limit the scope and applicability of this disclosure. It should be understood that other terminology, parts, components, and layouts could be used that would still embody the intentions of this disclosure. Individuals skilled in the art will recognize that examples described have suitable alternatives. It is also noted that the examples are not limited to specific construction materials, and that various suitable materials exist for the elements of this disclosure.

What is claimed is:

1. A desktop workspace that adjusts vertically, comprising:

a work surface platform;

a base configured to sit on an existing platform;

a height adjustment mechanism connecting the work surface platform and the base, the height adjustment mechanism including:

a first set of lift arms including a first arm pivotably and stationarily connected to the base, a first sliding mechanism providing sliding motion between the first arm and the work surface platform, a second arm rotatably connected to the first arm, and a second sliding mechanism providing sliding motion between the second arm and the base;

a second set of lift arms including a third arm rotatably connected to the work surface platform, a third sliding mechanism between the third arm and the base, and a fourth arm pivotably and stationarily connected to the base and rotatably connected to the third arm; and an element connecting the first set of lift arms to the second set of lift arms, wherein the first set of lift arms and the second set of lift arms move to create a lifting motion when raising and lowering the work surface platform to various heights, wherein the lifting motion when raising and lowering the work surface platform to various heights of the height adjustment mechanism moves the work surface platform in a straight vertical direction relative to the base; and a gas spring attached to the element to provide a force to assist in elevation of the work surface platform, wherein the gas spring is attached to the height adjustment mechanism via an arm pivot point, wherein the gas spring acts as a locking device that holds the work surface platform at various vertical heights above the base.

2. The desktop workspace of claim 1, wherein the fourth arm operates in parallel to the first arm during the lifting motion.

3. The desktop workspace of claim 2, wherein the third arm operates in parallel to the second arm during the lifting motion.

4. The desktop workspace of claim 1, wherein the first arm is rotatably connected to the base with a base pivot point, and wherein the third arm is rotatably connected to the work surface platform with a platform pivot point.

5. The desktop workspace of claim 1, wherein the gas spring extends between the height adjustment mechanism and the base.

6. The desktop workspace of claim 1, wherein the gas spring extends between the height adjustment mechanism and the work surface platform.

7. The desktop workspace of claim 1, wherein the gas spring is attached to the height adjustment mechanism via the element.

8. The desktop workspace of claim 1, wherein the element connects the first arm to the fourth arm.

9. The desktop workspace of claim 8, wherein the gas spring is attached to the element.

10. The desktop workspace of claim 9, wherein the element includes a cross beam.

11. The desktop workspace of claim 1, wherein the gas spring is a first spring, the desktop workspace comprising a pair of springs attached to the height adjustment mechanism to assist in the elevation of the work surface platform, the pair of springs including the first spring and a second spring.

12. The desktop workspace of claim 1, further comprising a keyboard platform that protrudes out, down, and parallel to the work surface platform.

13. The desktop workspace of claim 1, wherein the work surface platform forms an upper work surface, and wherein the gas spring is completely covered by a profile of the work surface platform when viewed from above the upper work surface relative to the base, the profile of the work surface platform being defined by an outer perimeter of the upper work surface.

14. The desktop workspace of claim 1, wherein the element extends between ends of the second arm and the third arm that are adjacent to the work surface platform.

15. The desktop workspace of claim 1, wherein the element is attached on the same side of the first arm as the second sliding mechanism relative to the pivotable connection between the first arm and the second arm.

16. A desktop workspace that adjusts vertically, comprising:

a work surface platform;

a base configured to sit on an existing platform;

a height adjustment mechanism connecting the work surface platform and the base, the height adjustment mechanism including:

a first set of lift arms including a first arm rotatably connected to the base, a first sliding mechanism between the first arm and the work surface platform, a second arm rotatably connected to the first arm, and a second sliding mechanism between the second arm and the base;

a second set of lift arms including a third arm rotatably connected to the work surface platform, a third sliding mechanism between the third arm and the base, and a fourth arm rotatably connected to the base and rotatably connected to the third arm; and an element connecting the first set of lift arms to the second set of lift arms, wherein the first set of lift arms and the second set of lift arms move to create a lifting motion when raising and lowering the work surface platform to various heights, wherein the lifting motion when raising and lowering the work surface platform to various heights of the height adjustment mechanism moves the work surface platform in a straight vertical direction relative to the base; and a gas spring attached to the height adjustment mechanism to provide a force to assist in elevation of the work surface platform, wherein the first arm, the third arm, and the gas spring are positioned side-by-side when the desktop workspace is in a fully lowered position.

17. A desktop workspace that adjusts vertically, comprising:

a work surface platform;

a base configured to sit on an existing platform;

a height adjustment mechanism connecting the work surface platform and the base, the height adjustment mechanism including:

a first set of lift arms including a first arm pivotably and stationarily connected to the base, a first sliding mechanism providing sliding motion between the first arm and the work surface platform, a second arm rotatably connected to the first arm, and a second sliding mechanism providing sliding motion between the second arm and the base;

a second set of lift arms including a third arm rotatably connected to the work surface platform, a third sliding mechanism between the third arm and the base, and a fourth arm pivotably and stationarily connected to the base and rotatably connected to the third arm; and an element connecting the first set of lift arms to the second set of lift arms, wherein the first set of lift arms and the second set of lift arms move to create a lifting motion when raising and lowering the work surface platform to various heights, wherein the lifting motion when raising and lowering the work surface platform to various heights of the height adjustment mechanism moves the work surface platform in a straight vertical direction relative to the base;

a gas spring attached to the element to provide a force to assist in elevation of the work surface platform;

a keyboard platform that protrudes out, down, and parallel to the work surface platform; and a keyboard tray mechanism configured to hold the keyboard platform in the position that protrudes out, down, and parallel to the work surface platform and to allow the keyboard platform to be stored under the work surface platform.

18. A desktop workspace that adjusts vertically, comprising:

a work surface platform;

a base configured to sit on an existing platform;

a height adjustment mechanism connecting the work surface platform and the base, the height adjustment mechanism including:

a first set of lift arms including a first arm pivotably and stationarily connected to the base, a first sliding mechanism providing continuous sliding motion between the first arm and the work surface platform, a second arm rotatably connected to the first arm, and a second sliding mechanism providing continuous sliding motion between the second arm and the base;

a second set of lift arms including a third arm rotatably connected to a fourth arm; and an element connecting the first set of lift arms to the second set of lift arms, wherein the first set of lift arms and the second set of lift arms move to create a lifting motion when raising and lowering the work surface platform to various heights, wherein the third arm operates in parallel to the first arm, and the fourth arm operates in parallel to the second arm, wherein the lifting motion when raising and lowering the work surface platform to various heights of the height adjustment mechanism moves the work surface platform in a straight vertical direction relative to the base; and a spring attached to the height adjustment mechanism to provide a force to assist in elevation of the work surface platform, wherein the spring is attached to the height adjustment mechanism via an arm pivot point.

19. The desktop workspace of claim 18, further comprising a locking device that holds the work surface platform at various vertical heights above the base.

20. The desktop workspace of claim 19, wherein the locking device includes a handle that disengages the locking device once pressure is applied by a user.

21. The desktop workspace of claim 19, wherein the locking device applies pressure to prevent the first set of lift arms from moving.

22. A desktop workspace that adjusts vertically, comprising:

a work surface platform;

a base configured to sit on an existing platform;

a height adjustment mechanism connecting the work surface platform and the base, the height adjustment mechanism including:

a first set of lift arms including a first arm pivotably connected to the work surface platform, a first sliding mechanism providing continuous sliding motion between the first arm and the base, a second arm rotatably connected to the first arm, and a second sliding mechanism providing continuous sliding motion between the second arm and the work surface platform;

a second set of lift arms including a third arm and to a fourth arm pivotably and stationarily connected to the base and rotatably connected to the third arm; and an element connecting the first set of lift arms to the second set of lift arms, wherein the first set of lift arms and the second set of lift arms move to create a lifting motion when raising and lowering the work surface platform to various heights, wherein the third arm operates in parallel to the first arm, and the fourth arm operates in parallel to the second arm, wherein the lifting motion when raising and lowering the work surface platform to various heights of the height adjustment mechanism moves the work surface platform in a straight vertical direction relative to the base; and a spring attached to the height adjustment mechanism to provide a force to assist in elevation of the work surface platform, wherein the spring is attached to the height adjustment mechanism via an arm pivot point.

23. A desktop workspace that adjusts vertically, comprising:

a work surface platform;

a base configured to sit on an existing platform;

a height adjustment mechanism connecting the work surface platform and the base, the height adjustment mechanism including:

a first set of lift arms including a first arm pivotably connected to the work surface platform, a first sliding mechanism providing continuous sliding motion between the first arm and the base, and a second arm rotatably connected to the base and rotatably connected to the first arm;

a second set of lift arms including a third arm rotatably connected to a fourth arm; and an element connecting the first set of lift arms to the second set of lift arms, wherein the first set of lift arms and the second set of lift arms move to create a lifting motion when raising and lowering the work surface platform to various heights, wherein the third arm operates in parallel to the first arm, and the fourth arm operates in parallel to the second arm, wherein the lifting motion when raising and lowering the work surface platform to various heights of the height adjustment mechanism moves the work surface platform in a straight vertical direction relative to the base; and a spring attached to the height adjustment mechanism to provide a force to assist in elevation of the work surface platform, wherein the spring is attached to the height adjustment mechanism via an arm pivot point.

24. The desktop workspace of claim 23, further comprising a locking device that holds the work surface platform at various vertical heights above the base.

25. A desktop workspace that adjusts vertically, comprising:

a work surface platform;

a base configured to sit on an existing platform;

a height adjustment mechanism connecting the work surface platform and the base, the height adjustment mechanism including:

a first set of lift arms including a first arm pivotably and stationarily connected to the base, a first sliding mechanism providing continuous sliding motion between the first arm and the work surface platform, and a second arm rotatably connected to the work surface platform and rotatably connected to the first arm;

a second set of lift arms including a third arm rotatably connected to a fourth arm; and an element connecting the first set of lift arms to the second set of lift arms, wherein the first set of lift arms and the second set of lift arms move to create a lifting motion when raising and lowering the work surface platform to various heights, wherein the third arm operates in parallel to the first arm, and the fourth arm operates in parallel to the second arm, wherein the lifting motion when raising and lowering the work surface platform to various heights of the height adjustment mechanism moves the work surface platform in a straight vertical direction relative to the base; and a spring attached to the height adjustment mechanism to provide a force to assist in elevation of the work surface platform, wherein the spring is attached to the height adjustment mechanism via an arm pivot point.

* * * * *